US007121348B2

(12) United States Patent
Hemphill et al.

(10) Patent No.: US 7,121,348 B2
(45) Date of Patent: Oct. 17, 2006

(54) MOUNTS FOR BLOWOUT PREVENTER BONNETS

(75) Inventors: Edward Ryan Hemphill, Houston, TX (US); Michael Wayne Berckenhoff, Spring, TX (US); William L. Carbaugh, Humble, TX (US)

(73) Assignee: Hydril Company LP, Houston, TX (US)

( * ) Notice: Subject to any disclaimer, the term of this patent is extended or adjusted under 35 U.S.C. 154(b) by 0 days.

(21) Appl. No.: 11/388,373

(22) Filed: Mar. 24, 2006

(65) Prior Publication Data

US 2006/0162936 A1 Jul. 27, 2006

Related U.S. Application Data

(63) Continuation of application No. 10/322,038, filed on Dec. 17, 2002, which is a continuation-in-part of application No. 09/849,218, filed on May 4, 2001, now Pat. No. 6,510,897.

(51) Int. Cl.
*E21B 33/06* (2006.01)

(52) U.S. Cl. ..... 166/373; 166/85.4; 251/1.3

(58) Field of Classification Search ..... 166/85.1, 166/85.4, 55.1, 381, 378, 373; 251/1.1, 1.3
See application file for complete search history.

(56) References Cited

U.S. PATENT DOCUMENTS

| | | | | |
|---|---|---|---|---|
| 3,658,287 | A * | 4/1972 | Lerouax | 251/1.3 |
| 4,253,638 | A * | 3/1981 | Troxell, Jr. | 251/1.3 |
| 5,575,452 | A * | 11/1996 | Whitby et al. | 251/1.3 |
| 5,655,745 | A * | 8/1997 | Morrill | 251/1.3 |
| 5,975,484 | A * | 11/1999 | Brugman et al. | 251/1.3 |
| 6,601,650 | B1 * | 8/2003 | Sundararajan | 166/361 |

* cited by examiner

*Primary Examiner*—Frank S. Tsay
(74) *Attorney, Agent, or Firm*—Osha Liang LLP

(57) ABSTRACT

A mount for a bonnet of a blowout preventer includes at least one support member coupled to a body of the blowout preventer, and a bonnet mounting member moveably coupled to the at least one support member and adapted to move substantially normal to a face of the body of the blowout blowout preventer, wherein the bonnet is coupled to the bonnet mounting member.

15 Claims, 22 Drawing Sheets

MOUNTS FOR BLOWOUT PREVENTER BONNETS

CROSS-REFERENCE TO RELATED APPLICATIONS

This is a continuation of U.S. patent application Ser. No. 10/322,038, filed on Dec. 17, 2002, which is a continuation-in-part of U.S. patent application Ser. No. 09/849,218, filed on May 4, 2001, now U.S. Pat. No. 6,510,897 and claims the benefit, pursuant to 35 U.S.C. §120, of that application. That application is incorporated by reference in its entirety.

BACKGROUND OF INVENTION

1. Field of the Invention

The invention relates generally to blowout preventers used in the oil and gas industry. Specifically, the invention relates to a blowout preventer with a novel bonnet securing mechanism.

2. Background Art

Well control is an important aspect of oil and gas exploration. When drilling a well in, for example, oil and gas exploration applications, devices must be put in place to prevent injury to personnel and equipment associated with the drilling activities. One such well control device is known as a blowout preventer (BOP).

Blowout preventers are generally used to seal a wellbore. For example, drilling wells in oil or gas exploration involves penetrating a variety of subsurface geologic structures, or "layers." Each layer generally comprises a specific geologic composition such as, for example, shale, sandstone, limestone, etc. Each layer may contain trapped fluids or gas at different formation pressures, and the formation pressures increase with increasing depth. The pressure in the wellbore is generally adjusted to at least balance the formation pressure by, for example, increasing a density of drilling mud in the wellbore or increasing pump pressure at the surface of the well.

There are occasions during drilling operations when a wellbore may penetrate a layer having a formation pressure substantially higher than the pressure maintained in the wellbore. When this occurs, the well is said to have "taken a kick." The pressure increase associated with the kick is generally produced by an influx of formation fluids (which may be a liquid, a gas, or a combination thereof) into the wellbore. The relatively high pressure kick tends to propagate from a point of entry in the wellbore uphole (from a high pressure region to a low pressure region). If the kick is allowed to reach the surface, drilling fluid, well tools, and other drilling structures may be blown out of the wellbore. These "blowouts" often result in catastrophic destruction of the drilling equipment (including, for example, the drilling rig) and in substantial injury or death of rig personnel.

Because of the risk of blowouts, blowout preventers are typically installed at the surface or on the sea floor in deep water drilling arrangements so that kicks may be adequately controlled and "circulated out" of the system. Blowout preventers may be activated to effectively seal in a wellbore until active measures can be taken to control the kick. There are several types of blowout preventers, the most common of which are annular blowout preventers and ram-type blowout preventers.

Annular blowout preventers typically comprise annular elastomer "packers" that may be activated (e.g., inflated) to encapsulate drillpipe and well tools and completely seal the wellbore. A second type of the blowout preventer is the ram-type blowout preventer. Ram-type preventers typically comprise a body and at least two oppositely disposed bonnets. The bonnets are generally secured to the body about their circumference with, for example, bolts. Alternatively, bonnets may be secured to the body with a hinge and bolts so that the bonnet may be rotated to the side for maintenance access.

Interior of each bonnet is a piston actuated ram. The rams may be either pipe rams (which, when activated, move to engage and surround drillpipe and well tools to seal the wellbore) or shear rams (which, when activated, move to engage and physically shear any drillpipe or well tools in the wellbore). The rams are typically located opposite of each other and, whether pipe rams or shear rams, the rams typically seal against one another proximate a center of the wellbore in order to completely seal the wellbore.

As with any tool used in drilling oil and gas wells, blowout preventers must be regularly maintained. For example, blowout preventers comprise high pressure seals between the bonnets and the body of the BOP. The high pressure seals in many instances are elastomer seals. The elastomer seals must be regularly checked to ensure that the elastomer has not been cut, permanently deformed, or deteriorated by, for example, chemical reaction with the drilling fluid in the wellbore. Moreover, it is often desirable to replace pipe rams with shear rams, or vice versa, to provide different well control options. Therefore, it is important that the blowout preventer includes bonnets that are easily removable so that interior components, such as the rams, may be accessed and maintained.

Developing blowout preventers that are easy to maintain is a difficult task. For example, as previously mentioned, bonnets are typically connected to the BOP body by bolts or a combination of a hinge and bolts. The bolts must be highly torqued in order to maintain a seal between a bonnet door and the BOP body. The seal between the bonnet and the BOP body is generally a face seal, and the seal must be able to withstand the very high pressures present in the wellbore.

As a result, special tools and equipment are necessary to install and remove the bonnet doors and bonnets so that the interior of the BOP body may be accessed. The time required to install and remove the bolts connecting the bonnet doors to the BOP body results in rig downtime, which is both expensive and inefficient. Moreover, substantially large bolts and a nearly complete "bolt circle" around the circumference of the bonnet door are generally required to provide sufficient force to hold the bonnet door against the body of the BOP. The size of the bolts and the bolt circle may increase a "stack height" of the BOP. It is common practice to operate a "stack" of BOPs (where several BOPs are installed in a vertical relationship), and a minimized stack height is desirable in drilling operations.

Several attempts have been made to reduce stack height and the time required to access the interior of the BOP. U.S. Pat. No. 5,655,745 issued to Morrill shows a pressure energized seal carrier that eliminates the face seal between the bonnet door and the BOP body. The BOP shown in the '745 patent enables the use of fewer, smaller bolts in less than a complete bolt circle for securing the bonnet to the body. Moreover, the '745 patent shows that a hinge may be used in place of at least some of the bolts.

U.S. Pat. No. 5,897,094 issued to Brugman et al. discloses an improved BOP door connection that includes upper and lower connector bars for securing bonnets to the BOP. The improved BOP door connection of the '094 patent does not use bolts to secure the bonnets to the BOP and discloses a design that seeks to minimize a stack height of the BOP.

SUMMARY OF INVENTION

In one aspect, the invention relates to a mount for a bonnet of a blowout preventer that includes at least one support member coupled to a body of the blowout preventer, and a bonnet mounting member moveably coupled to the at least one support member and adapted to move substantially normal to a face of the body of the blowout preventer. In some embodiments, the support members are adapted to have wheels travel along a top surface thereof and the bonnet mounting member includes at least one wheel. In other embodiments, the at least one support member comprises a first support member hingedly coupled to the body of the blowout preventer and a second support member hingedly coupled to the body of the blowout preventer. In other embodiments, the at least one support member comprises a first support member hingedly coupled to a first side of the side opening of the blowout preventer and a second support member hingedly coupled to the first side of the side opening of the blowout preventer.

In one aspect, the invention relates to a mount for a bonnet of a blowout preventer comprising a first support member coupled to a body of the blowout preventer, and a second support member coupled to the body of a blowout preventer, wherein the bonnet is moveably coupled to the first support member and to the second support member and is adapted to move substantially normal to a face of the body of the blowout preventer and wherein the bonnet is rotationally coupled to the first support member and to the second support member and is adapted to rotate about a horizontal axis.

In one aspect, the invention relates to a mount for a bonnet of a blowout preventer comprising a first support member moveably coupled to a the body of the blowout preventer and coupled to the bonnet, and a second support member moveably coupled to the body of the blowout preventer and coupled to the bonnet.

Another aspect of the invention related to a mount for a bonnet of a blowout preventer comprising a first hinge member hingedly coupled to the body of the blowout preventer, and a second hinge member hingedly coupled to the bonnet, wherein the first hinge member is hingedly coupled to the second hinge member to enable the bonnet to move substantially normal to a face of the body of the blowout preventer.

In one aspect, the invention relates to a support device for a bonnet of a blowout preventer comprising at least one support member moveably coupled to the bonnet and adapted to enable the bonnet to move substantially normal to a face of a body of the blowout preventer. In some embodiments, the at least one support member is rotationally coupled to the bonnet.

In one aspect, the invention relates to methods for accessing a ram attached to a bonnet of a blowout preventer, the method comprising disengaging the bonnet from a body of the blowout preventer, moving the bonnet away from the body of the blowout preventer in a direction substantially normal to a face of the body of the blowout preventer, and accessing the ram.

Other aspects and advantages of the invention will be apparent from the following description and the appended claims.

DETAILED DESCRIPTION

Figure 1:
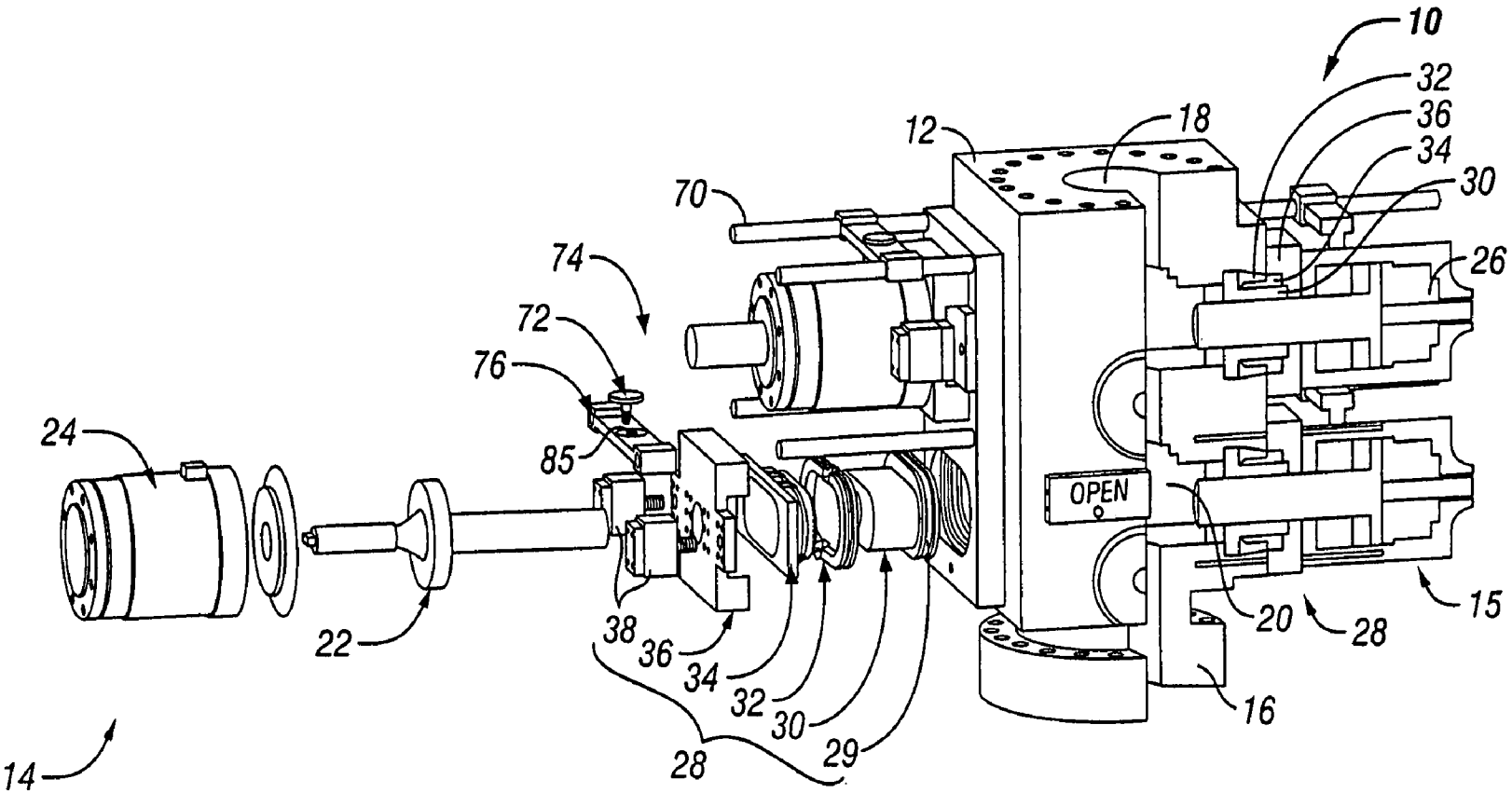
FIG. 1 shows a partial section and exploded view of a BOP comprising an embodiment of the invention.

An embodiment of the invention is shown in FIG. 1. A ram-type blowout preventer (BOP) 10 comprises a BOP body 12 and oppositely disposed bonnet assemblies 14. The BOP body 12 further comprises couplings 16 (which may be, for example, flanges) on an upper surface and a lower surface of the BOP body 12 for coupling the BOP 10 to, for example, another BOP or to another well tool. The BOP body 12 comprises an internal bore 18 therethrough for the passage of drilling fluids, drillpipe, well tools, and the like used to drill, for example, an oil or gas well. The BOP body 12 further comprises a plurality of side passages 20 wherein each of the plurality of side passages 20 is generally adapted to be coupled to a bonnet assembly 14.

The bonnet assemblies 14 are coupled to the BOP body 12, typically in opposing pairs as shown in FIG. 1. Each bonnet assembly 14 further comprises a plurality of components adapted to seal the bonnet assembly 14 to the BOP body 12 and to activate a ram piston 22 within each bonnet assembly 14. Components of the bonnet assemblies 14 comprise passages therethrough for movement of the ram piston 22.

Each bonnet assembly 14 generally comprises similar components. While each bonnet assembly 14 is a separate and distinct part of the BOP 10, the operation and structure of each bonnet assembly 14 is similar. Accordingly, in order to simplify the description of the operation of the BOP 10 and of the bonnet assemblies 14, the components and operation of one bonnet assembly 14 will be described in detail. It should be understood that each bonnet assembly 14 operates in a similar manner and that, for example, opposing bonnet assemblies 14 typically operate in a coordinated manner.

Proceeding with the description of the operation of one bonnet assembly 14, the piston 22 is adapted to be coupled to a ram (not shown) that may be, for example, a pipe ram or a shear ram. Each ram piston 22 is coupled to a ram actuator cylinder 24 that is adapted to displace the ram piston 22 axially within the bonnet assembly 14 in a direction generally perpendicular to an axis of the BOP body 12, the axis of the BOP body 12 being generally defined as a vertical axis of the internal bore 18 (which is generally parallel with respect to a wellbore axis). A ram (not shown) is generally coupled to the ram piston 22, and, if the rams (not shown) are shear rams, the axial displacement of the ram piston 22 generally moves the ram (not shown) into the internal bore 18 and into contact with a corresponding ram (not shown) coupled to a ram piston 22 in a bonnet assembly 14 disposed on an opposite side of the BOP 10.

Alternatively, if the rams (not shown) are pipe rams, axial displacement of the ram piston generally moves the ram (not shown) into the internal bore 18 and into contact with a corresponding ram (not shown) and with drillpipe and/or well tools present in the wellbore. Therefore, activation of the ram actuator cylinder 24 displaces the ram piston 22 and moves the ram (not shown) into a position to block a flow of drilling and/or formation fluid through the internal bore 18 of the BOP body 12 and, in doing so, to form a high pressure seal that prevents fluid flow from passing into or out of the wellbore (not shown).

The ram actuator cylinder 24 further comprises an actuator 26 which may be, for example, a hydraulic actuator. However, other types of actuators are known in the art and may be used with the invention. Note that for purposes of the description of the invention, a "fluid" may be defined as a gas, a liquid, or a combination thereof.

For example, if the ram (not shown) is a pipe ram, activation of the ram piston 22 moves the ram (not shown) into position to seal around drillpipe (not shown) or well tools (not shown) passing through the internal bore 18 in the BOP body 12. Further, if the ram (not shown) is a shear ram, activation of the ram piston 22 moves the ram (not shown) into position to shear any drillpipe (not shown) or well tools (not shown) passing through the internal bore 18 of the BOP body 12 and, therefore, seal the internal bore 18.

Radial Lock Mechanism for Coupling Bonnets to BOPs

An important aspect of a BOP 10 is the mechanism by which the bonnet assemblies 14 are sealed to the body 12. FIG. 1 shows a radial lock mechanism 28 that is designed to provide a high pressure radial seal between the bonnet assembly 14 and the BOP body 12. Moreover, the radial lock mechanism 28 is designed to simplify maintenance of the bonnet assembly 14 and the rams (not shown) positioned therein.

In the embodiments shown in the Figures, the side passages 20 and other components of the BOP 10 designed to be engaged therewith and therein are shown as being oval or substantially elliptical in shape. An oval or substantially elliptical shape (e.g., an oval cross-section) helps reduce the stack height of the BOP, thereby minimizing weight, material used, and cost. Other shapes such as circular shapes, however, are also suitable for use with the invention. Accordingly, the scope of the invention should not be limited to the shapes of the embodiments shown in the Figures.

The radial lock mechanism 28 is positioned within the bonnet assembly 14 and within the side passage 20 of the BOP body 12. In this embodiment, the radial lock mechanism 28 comprises a bonnet seal 29 disposed on a bonnet body 30, a radial lock 32, a radial lock displacement device 34, a bonnet door 36, and lock actuators 38. The bonnet seal 29 cooperatively seals the bonnet body 30 to the BOP body 12 proximate the side passage 20. The bonnet seal 29 comprises a high pressure seal that prevents fluids from the internal bore 18 of the BOP body 12 from escaping via the side passage 20. Various embodiments of the bonnet seal 29 will be discussed in detail below.

When the bonnet seal 29 is formed between the bonnet body 30 and the BOP body 12, the bonnet body 30 is in an installed position and is located proximate the BOP body 12 and at least partially within the side passage 20. Because the bonnet seal 29 is a high pressure seal, the radial lock mechanism 28 must be robust and able to withstand very high pressures present in the internal bore 18.

Figure 2:
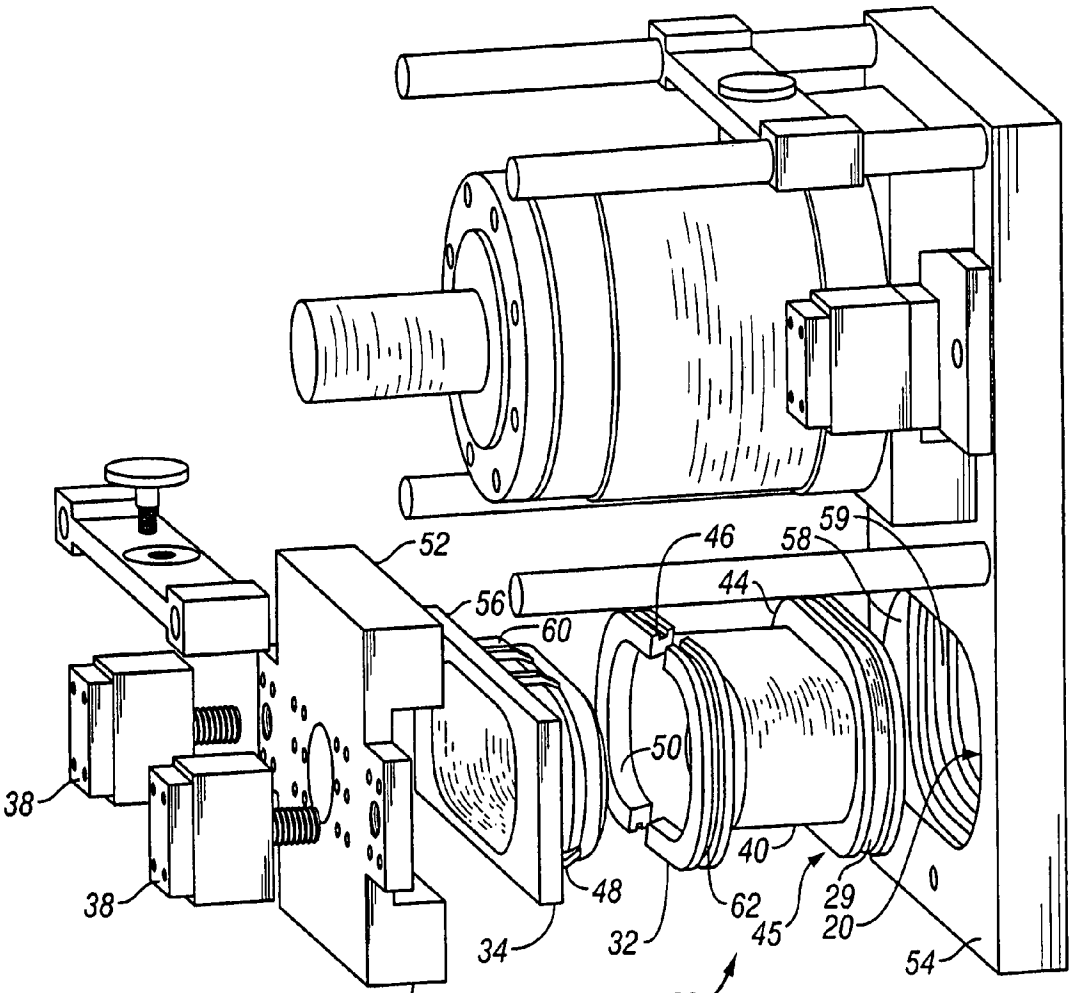
FIG. 2 shows an enlarged view of a portion of the embodiment shown in FIG. 1.

The embodiment shown in FIG. 1 comprises a novel mechanism for locking the bonnet assembly 14 (and, as a result, the bonnet seal 29) in place. Referring to FIG. 2, the radial lock 32 has an inner diameter adapted to fit over an exterior surface 40 of the bonnet body 30 and slide into a position adjacent a sealing end of the bonnet body 30. The radial lock 32 shown in FIG. 2 comprises two halves separated by a center cut 46. However, the radial lock 32 may comprise additional segments and the two segment embodiment shown in FIG. 2 is not intended to limit the scope of the invention. Additional embodiments of the radial lock 32 will be described in greater detail below.

The radial lock displacement device 34 also has an inner diameter adapted to fit over the exterior surface 40 of the bonnet body 30. Moreover, the radial lock displacement device 34 further comprises a wedge surface 48 on an external diameter that is adapted to fit inside an inner diameter 50 of the radial lock 32. The radial lock displacement device 34 also comprises an inner face 56 that is adapted to contact an outer surface 54 of the BOP body 12. In an installed position, the bonnet body 30, the radial lock 32, and the radial lock displacement device 34 are positioned between the BOP body 12 and the bonnet door 36. An inner surface 52 of the bonnet door 36 is adapted to contact the outer surface 54 of the BOP body 12. Note that the engagement between the bonnet door 36 and the BOP body 12 is not fixed (e.g., the bonnet door 36 is not bolted to the BOP body 12).

Referring again to FIG. 1, the bonnet assembly 14 is adapted to slidably engage at least one rod 70 through a swivel slide mount 74 (note that two rods 70 are shown slidably engaged, through the swivel slide mounts 74, with each bonnet assembly 14 in FIG. 1). As a result of the slidable engagement, the bonnet assembly 14 may slide along the rods 70. As will be discussed below, the slidable engagement permits the bonnet assembly 14 to be moved into and out of locking and sealing engagement with the BOP body 12.

The lock actuators 38 are coupled to the bonnet door 36 with either a fixed or removable coupling comprising bolts, adhesive, welds, threaded connections, or similar means known in the art. The lock actuators 38 are also cooperatively coupled to the radial lock displacement device 34 in a similar fashion. Additionally, the coupling between the lock actuators 38 and the radial lock displacement device 34 may be a simple contact engagement. Note that the embodiments in FIG. 1 shows two lock actuators 38 coupled to each bonnet door 36. However, a single lock actuator cylinder 38 or a plurality of lock actuators 38 may be used with the invention. The lock actuators 38 shown are generally hydraulic cylinders; however, other types of lock actuators (including, for example, pneumatic actuators, electrically powered motors, and the like) are known in the art and may be used with the invention.

Moreover, the lock actuators 38 may also be manually operated. The lock actuators 38 shown in the present embodiment are typically controlled by, for example, an external electrical signal, a flow of pressurized hydraulic fluid, etc. As an alternative, the radial lock 32 may be activated by manual means, such as, for example, a lever, a system of levers, a threaded actuation device, or other similar means known in the art. Further, if, for example, the lock actuators 38 comprise hydraulic cylinders, the hydraulic cylinders may be activated by a manual pump. Accordingly, manual activation of the radial lock 32 is within the scope of the invention.

A fully assembled view of the bonnet assembly 14 including the radial lock mechanism 28 is shown in FIG. 2. During operation of the radial lock mechanism 28, the bonnet assembly 14 is first moved into position proximate the BOP body 12 by sliding the bonnet assembly 14 toward the BOP body 12 on the rods 70. The lock actuators 38 are then activated so that they axially displace (wherein an axis of displacement corresponds to an axis of the side passage 20) the radial lock displacement device 34 in a direction toward the BOP body 12. As the radial lock displacement device 34 moves axially toward the BOP body 12, the wedge surface 48 contacts the inner diameter 50 of the radial lock 32, thereby moving the radial lock 32 in a radially outward direction (e.g., toward an inner radial lock surface 58 of the side passage 20). When the activation of the radial lock mechanism 28 is complete, an inner nose 60 of the radial lock displacement device 34 is proximate a load shoulder 44 of the bonnet body 30, and an outer perimeter 62 of the radial lock 32 is lockingly engaged with the inner radial lock surface 58. Moreover, as will be described below, both the radial lock 32 and the inner radial lock surface 58 typically comprise angled surfaces (refer to, for example, the engagement surfaces described in the discussion of FIGS. 10 and 11 infra). When the radial lock 32 engages the inner radial lock surface 58, the angled surfaces are designed to provide an axial force that "pulls" the bonnet door 36 in an axially inward direction and firmly against the exterior of the BOP body 12 and thereby completes the locking engagement of the radial lock mechanism 28.

When the radial lock 32 is secured in place by the activation of the lock actuators 38 and the radial lock displacement device 34, the bonnet body 30 and the bonnet assembly 14 are axially locked in place with respect to the BOP body 12 without the use of, for example, bolts. However, an additional manual locking mechanism (not shown) may also be used in combination with the invention to ensure that the radial lock 32 remains securely in place. Once the radial lock 32 is secured in place by, for example, hydraulic actuation, a manual lock (not shown), such as a pinned or threaded mechanism, may be activated as an additional restraint. The secured radial locking mechanism 28 is designed to hold the bonnet assembly 14 and, accordingly, the high pressure bonnet seal 29 in place. The radial lock 32 and the high pressure bonnet seal 29 can withstand the high forces generated by the high pressures present within the internal bore 18 of the BOP body 12 because of the locking engagement between the radial lock 32 and the inner radial lock surface 58 of the BOP body 12.

The radial lock mechanism 28 may be disengaged by reversing the activation of the lock actuators 38 (e.g., after the pressure in the internal bore 18 has been relieved). As a result, the invention comprises a radial lock mechanism 28 that includes a positive disengagement system (e.g., the lock actuators 38 must be activated in order to disengage the radial lock mechanism 28).

Figure 3:
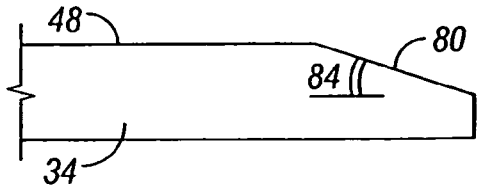
FIG. 3 shows an embodiment of a radial lock displacement device.

The wedge surface 48 used to radially displace the radial lock 32 may comprise any one of several embodiments. Referring to FIG. 3, in one embodiment, the wedge surface 48 of the radial lock displacement device 34 may comprise a single actuation step 80. In another embodiment shown in FIG. 4, the wedge surface 48 may comprise a dual actuation step 82. Note that the single actuation step (80 in FIG. 3) generally has a shorter actuation stroke than the dual actuation step (82 in FIG. 4). Further, an actuation step angle (84 in FIGS. 3 and 4) is designed to maximize a radial actuation force and minimize a linear actuation force. In one embodiment of the invention, the actuation step angle (84 in FIGS. 3 and 4) is approximately 45 degrees. In another embodiment of the invention, the actuation step angle (84 in FIGS. 3 and 4) is less than 45 degrees.

Figure 5:
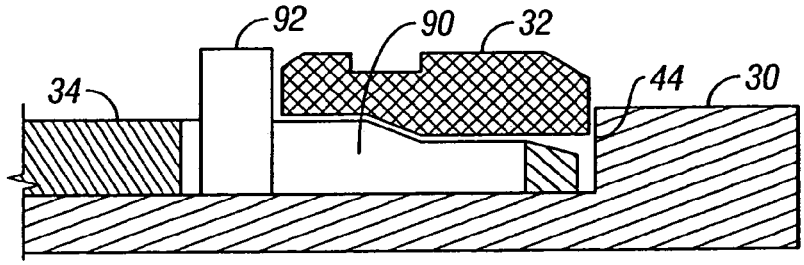
FIG. 5 shows and embodiment of the invention where a radial lock is pinned to a portion of a bonnet.

In another embodiment shown in FIG. 5, the radial lock displacement device 34 further comprises a slot 90 and at least one retention pin 92 designed to retain the radial lock 32 against the load shoulder 44 of the bonnet body 30. In this embodiment, the radial lock 32 is retained in place by the at least one retention pin 92, and the bonnet body 30 and the radial lock 32 are held in a fixed relationship after the radial lock 32 has been actuated and is in locking engagement with the inner radial lock surface (58 in FIG. 2) of the side passage (20 in FIG. 1).

Figure 6:
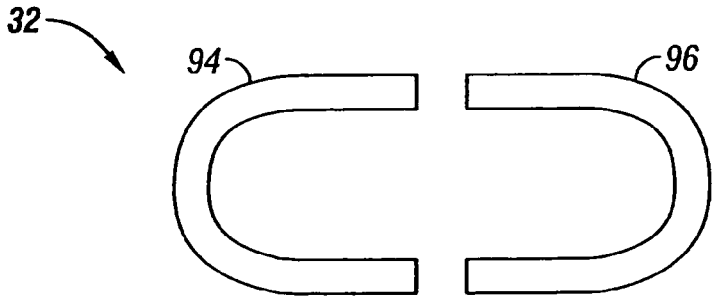
FIG. 6 shows an embodiment of a radial lock comprising two halves.
Figure 7:
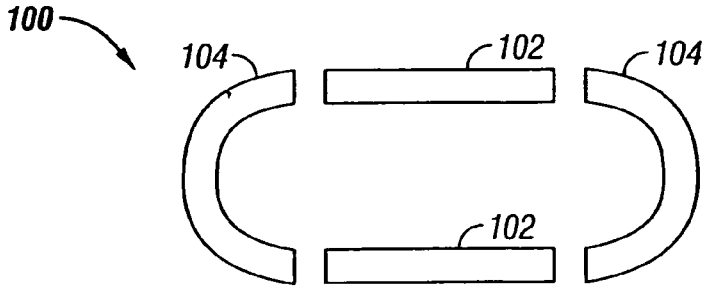
FIG. 7 shows an embodiment of a radial lock comprising four segments.
Figure 8:
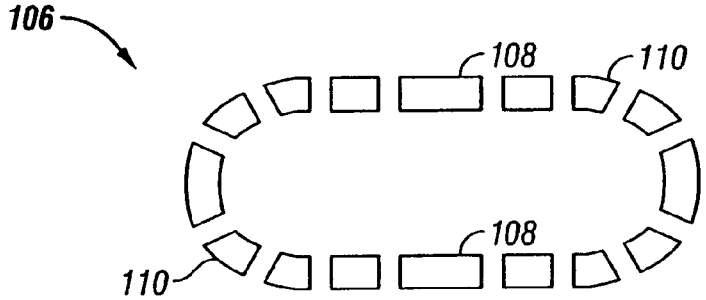
FIG. 8 shows an embodiment of a radial lock comprising a plurality of segments.

The radial lock (32 in FIG. 1) may also comprise any one of several embodiments. The radial lock 32 shown in the embodiment of FIG. 1 comprises two radial mirrored halves 94, 96, as further shown in FIG. 6. In another embodiment, as shown in FIG. 7, a radial lock 100 may be formed from at least two substantially linear segments 102 and at least two semicircular end segments 104. In another embodiment, as shown in FIG. 8, a radial lock 106 may be formed from a plurality of substantially straight dogs 108 and a plurality of curved dogs 110. The embodiments shown in FIGS. 7 and 8 essentially comprise radial locks 100, 106 similar to the radial lock (32 in FIGS. 1 and 6) of the first embodiment but divided into a plurality of segments. The radial locks 100, 106 could be manufactured by, for example, manufacturing a solid radial lock and sequentially saw cutting the solid radial lock into two or more segments. However, other manufacturing techniques are known in the art and may be used to manufacture the radial lock.

Figure 9:
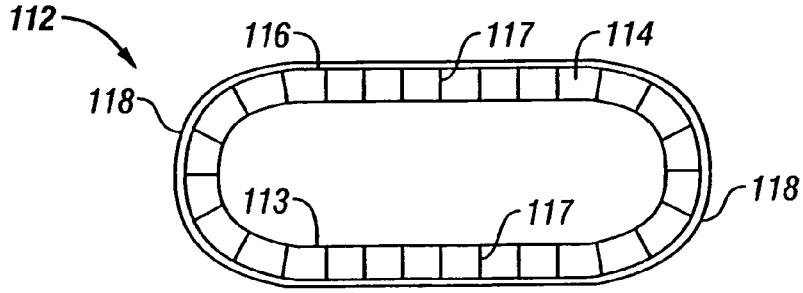
FIG. 9 shows an embodiment of a notched serpentine radial lock.

In another embodiment shown in FIG. 9, a radial lock 112 may be formed from a notched serpentine structure 114 similar to a "serpentine belt." The radial lock 112 is formed, for example, as a single solid piece and then cut 117 through an inner perimeter 114 or an outer perimeter 116. The cuts 117 can either completely transect the radial lock 112 or may include only partial cuts. Further, if the cuts 117 transect the radial lock 112, the individual segments can be attached to a flexible band 118 so that the radial lock 112 can be actuated with an actuating ring (34 in FIG. 1). The flexible band 118 may comprise a material with a relatively low elastic modulus (when compared to, for example, the elastic modulus of the individual segments) so that the flexible band 118 can radially expand in response to the radial displacement produced by the radial lock displacement device (34 in FIG. 1). Radial expansion of the flexible band 118 results in a locking engagement between the radial lock 112 and the inner radial lock surface (58 in FIG. 2) of the BOP body (12 in FIG. 1).

Figure 10:
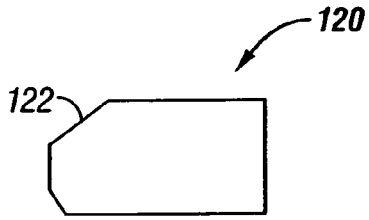
FIG. 10 shows an embodiment of a locking mechanism used in an embodiment of the invention.

The engagement between the radial lock (32 in FIG. 1) and the inner radial lock surface (58 in FIG. 2) may also comprise different embodiments. In one embodiment, as shown in FIG. 10, a radial lock 120 may comprise a single profile engagement including a single radial lock engagement surface 122. The single radial lock engagement surface 122 is designed to lockingly engage a BOP engagement surface (59 in FIG. 2) formed on the inner radial lock surface (58 in FIG. 2) of the side passage (20 in FIG. 1).

Figure 11:
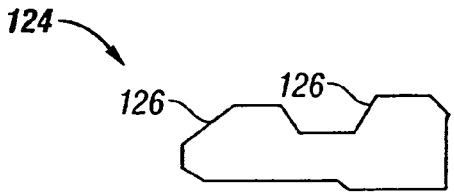
FIG. 11 shows an embodiment of a locking mechanism used in an embodiment of the invention.

In another embodiment, as shown in FIG. 11, a radial lock 124 comprises a dual profile engagement including two radial lock engagement surfaces 126. Moreover, the radial lock 124 may also comprise a plurality of radial lock engagement surfaces designed to lockingly engage a corresponding number of BOP engagement surfaces (59 in FIG. 2) formed on the inner radial lock surface (58 in FIG. 2) of the side passage (20 in FIG. 1) of the BOP body (12 in FIG. 1).

The radial locks described in the referenced embodiments are designed so that the cross-sectional area of engagement between the radial lock engagement surfaces with the BOP engagement surfaces (59 in FIG. 2) is maximized. Maximizing the cross-sectional areas of engagement ensures that the radial locks positively lock the bonnet assembly (14 in FIG. 1) and, as a result, the bonnet seal (29 in FIG. 1) in place against the high pressures present in the internal bore (18 in FIG. 1) of the BOP (10 in FIG. 1). Moreover, as discussed previously, angles of the engagement surfaces may be designed to produce an axial force that firmly pulls the bonnet door (36 in FIG. 1) against the BOP body (12 in FIG. 1) and that in some embodiments may assist in the activation of the bonnet seal (29 in FIG. 1).

The radial locks and the engagement surfaces described in the foregoing embodiments may be coated with, for example, hardfacing materials and/or friction reducing materials. The coatings may help prevent, for example, galling, and may prevent the radial locks from sticking or "hanging-up" in the engagement surfaces during the activation and/or deactivation of the radial lock mechanism (28 in FIG. 1). The coatings may also increase the life of the radial locks and the engagement surfaces by reducing friction and wear.

Figure 12:
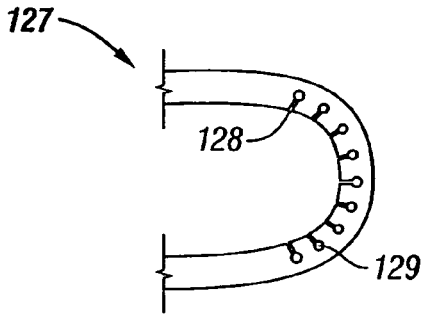
FIG. 12 shows an embodiment of a locking mechanism used in an embodiment of the invention.

Another embodiment of the lock ring is shown at 127 in FIG. 12. The radial lock 127 comprises a plurality of saw cuts 128, a plurality of holes 129, or a combination thereof. The saw cuts 128 and/or holes 129 decrease the weight and area moment of inertia of the radial lock 127, thereby reducing the actuation force required to radially displace the radial lock 127. In order to permit some elastic deformation of the radial lock 127, the radial lock 127 may be formed from a material having a relatively low modulus of elasticity (when compared to, for example, steel). Such materials comprise titanium, beryllium copper, etc. Moreover, modifications to the radial lock 127 geometry, in addition to those referenced above, may be made to, for example, further reduce the area moment of inertia of the radial lock 127 and reduce bending stresses.

The radial locks described above are designed to operate below an elastic limit of the materials from which they are formed. Operation below the elastic limit ensures that the radial locks will not permanently deform and, as a result of the permanent deformation, lose effectiveness. Accordingly, material selection and cross-sectional area of engagement of the engagement surfaces is very important to the design of the radial lock mechanism (28 in FIG. 1).

Referring to FIG. 1, the bonnet seal 29 is designed to withstand the high pressures present in the internal bore 18 of the BOP body 12 and to thereby prevent fluids and/or gases from passing from the internal bore 18 to the exterior of the BOP 10. The bonnet seal 29 may comprise several different configurations as shown in the following discussion of FIGS. 13–17. Moreover, the seals disclosed in the discussion below may be formed from a variety of materials. For example, the seals may be elastomer seals or non-elastomer seals (such as, for example, metal seals, PEEK seals, etc.). Metal seals may further comprise metal-to-metal C-ring seals and/or metal-to-metal lip seals. Further, the sealing arrangements shown below may include a combination of seal types and materials. Accordingly, the type of seal, number of seals, and the material used to form radial and face seals are not intended to limit the bonnet seal 29.

Figure 13:
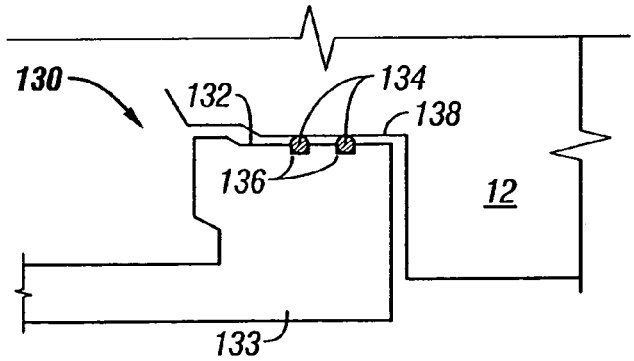
FIG. 13 shows an embodiment of a high pressure seal used in an embodiment of the invention.

The embodiment in FIG. 13 comprises a bonnet seal 130 formed on a radial perimeter 132 of a bonnet body 133. The radial seal 130 further comprises two o-rings 134 disposed in grooves 136 formed on the radial perimeter 132 of the bonnet body 133. The o-rings 134 sealingly engage an inner sealing perimeter 138 of the side passage (20 in FIG. 1) in the BOP body 12. The embodiment shown in FIG. 13 comprises two grooves 136, but a single groove or a plurality of grooves may be suitable for use with the o-rings 134. Moreover, while the embodiment shows two o-rings 134, a single o-ring or more than two o-rings may be used in the invention.

Figure 14:
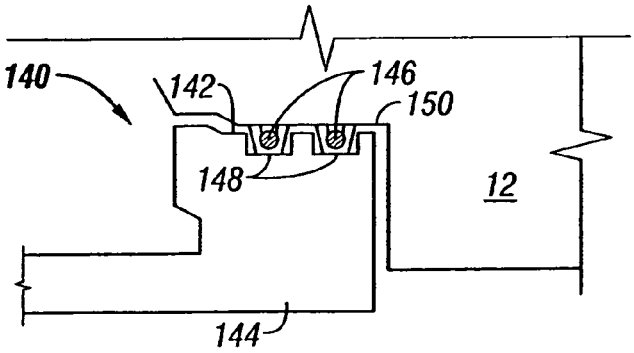
FIG. 14 shows an embodiment of a high pressure seal used in an embodiment of the invention.

In another embodiment shown in FIG. 14, a bonnet seal 140 comprises at least two packing seals 146 (which may be, for example, t-seals, lip seals, or seals sold under the trademark PolyPak, which is a mark of Parker Hannifin, Inc.) disposed in grooves 148 formed on a radial perimeter 142 of a bonnet body 144. The packing seals 146 sealingly engage an inner sealing perimeter 150 of the side passage (20 in FIG. 1) of the BOP body 12. The embodiment shown in FIG. 14 comprises two grooves 148, but a single groove or a plurality of grooves may be suitable for use with the packing seals 146. Moreover, while the embodiment shows two packing seals 146, a single seal or more than two seals may be used in the invention.

Figure 15:
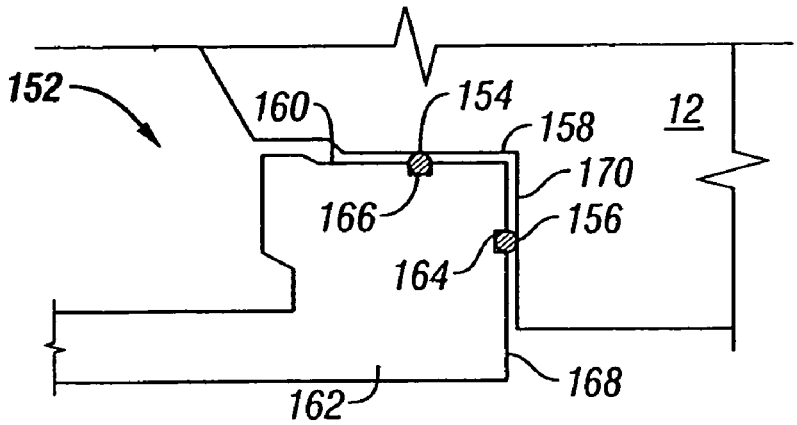
FIG. 15 shows an embodiment of a high pressure seal used in an embodiment of the invention.

In another embodiment shown in FIG. 15, the bonnet seal 152 comprises a radial seal 154 disposed in a groove 166 formed on a radial perimeter 160 of a bonnet body 162. Moreover, the embodiment comprises a face seal 156 disposed in a groove 164 formed on a mating face surface 168 of the bonnet body 162. The radial seal 154 is adapted to sealingly engage an inner sealing perimeter 158 of the side passage (20 in FIG. 1) of the BOP body 12. The face seal 156 is adapted to sealingly engage an exterior face 170 of the BOP body 12. The radial seal 154 and face seal 156 shown in the embodiment are both o-rings and are disposed in single grooves 166, 164. However, a different type of seal (such as, for example, a packing seal) and more than one seal (disposed in at least one groove) may be used with the invention.

Figure 16:
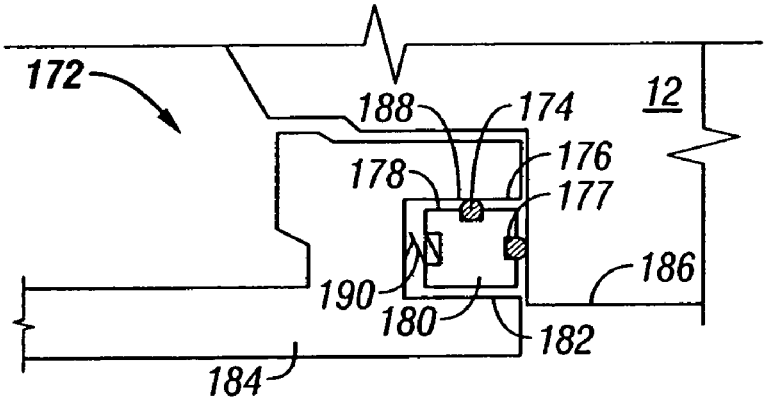
FIG. 16 shows an embodiment of a high pressure seal used in an embodiment of the invention.

In another embodiment shown in FIG. 16, the bonnet seal 172 comprises a radial seal 174 disposed in a groove 178 formed on a seal carrier 180. The seal carrier 180 is disposed in a groove 182 formed in a bonnet body 184 and also comprises a face seal 176 disposed in a groove 177 formed on the seal carrier 180. The face seal 176 is adapted to sealingly engage mating face surface 186 of the BOP body 12, and the radial seal is adapted to sealingly engage an inner sealing perimeter 188 formed on the bonnet body 184. The bonnet seal 172 may also comprise an energizing mechanism 190 that is adapted to displace the seal carrier 180 in a direction toward the exterior surface 186 of the BOP body 12 so as to energize the face seal 176. The energizing mechanism 190 may comprise, for example, a spring, a thrust washer, or a similar structure.

The energizing mechanism 190 helps ensure that the face seal 176 maintains positive contact with and, thus, maintains a high pressure seal with the exterior surface 186 of the BOP body 12. However, the energizing mechanism 190 is not required in all embodiments. For example, the seal carrier 180 may be designed so that both the radial seal 174 and the face seal 176 are pressure activated without the assistance of an energizing mechanism 190.

In the embodiment without an energizing mechanism, a diameter and an axial thickness of a seal carrier (such as the seal carrier 180 shown in FIG. 16) are selected so that high pressure from the internal bore first moves the seal carrier toward the exterior surface of the BOP body. Once the face seal sealingly engages the exterior surface, the high pressure from the internal bore causes the seal carrier to radially expand until the radial seal sealingly engages the groove in the seal carrier. A similar design is disclosed in U.S. Pat. No. 5,255,890 issued to Morrill and assigned to the assignee of the present invention. The '890 patent clearly describes the geometry required for such a seal carrier.

In the embodiment shown in FIG. 16, the face seal 176 and the radial seal 174 may be, for example, o-rings, packing seals, or any other high pressure seal known in the art. Moreover, FIG. 16 only shows single seals disposed in single grooves. However, more than one seal, more than one groove, or a combination thereof may be used with the invention.

Figure 17:
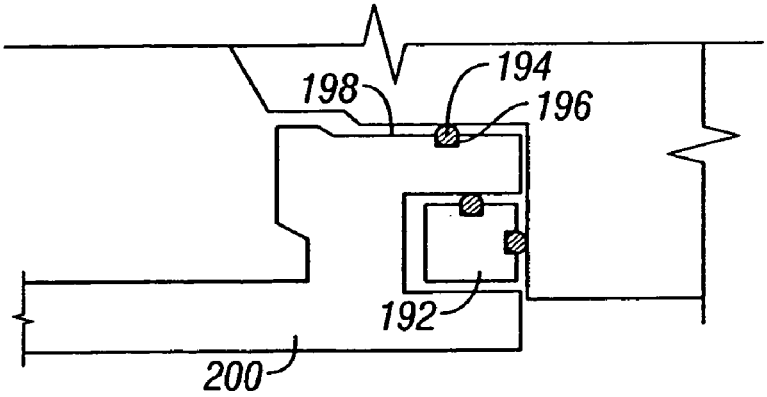
FIG. 17 shows an embodiment of a high pressure seal used in an embodiment of the invention.

In another embodiment shown in FIG. 17, the seal carrier 192 as shown in the previous embodiment is used in combination with a backup seal 194 disposed in a groove 196 on an external surface 198 of a bonnet body 200. The backup seal 194 may be an o-ring, a packing seal, a metal seal, or any other high pressure seal known in the art. The backup seal 194 further maintains a high pressure seal if, for example, there is leakage from the seals disposed on the seal carrier 192. Note that the embodiment shown in FIG. 17 does not include an energizing mechanism.

Advantageously, some of the seal embodiments reduce an axial force necessary to form the bonnet seal. The bonnet seals shown above greatly reduce the sensitivity of the bonnet seal to door flex by maintaining a constant squeeze regardless of wellbore pressure. The radial seal arrangements also reduce the total area upon which wellbore pressure acts and thus reduces a separation force that acts to push the bonnet door away from the BOP body.

Figure 18:
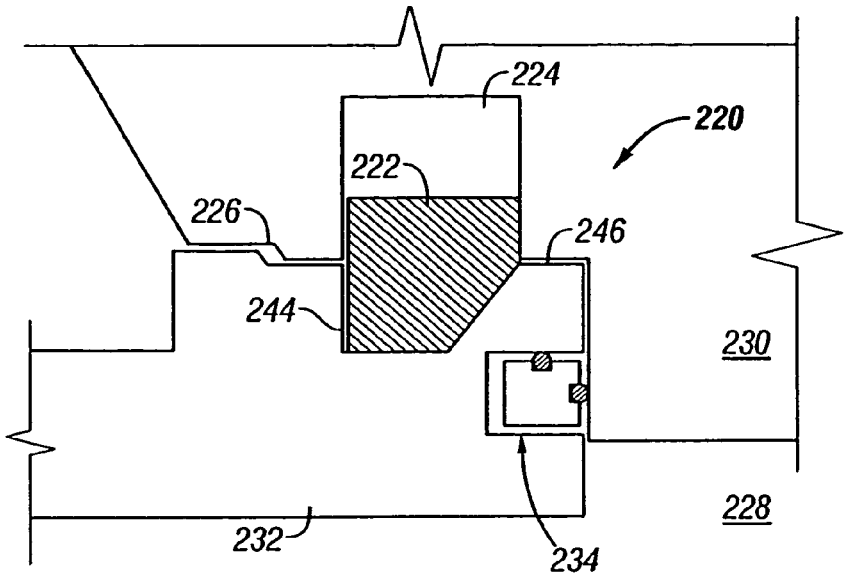
FIG. 18 shows an embodiment of the invention wherein a radial lock is disposed in a recess in a side passage of a BOP body.

In another embodiment of the radial lock shown in FIG. 18, the radial lock mechanism 220 comprises a radial lock 222 disposed in a recess 224 formed on an internal surface 226 of a side passage 228 of a BOP body 230. The operation of the radial lock mechanism 220 differs from the embodiments described above in that securing a bonnet body 232 and, accordingly, a bonnet door (not shown) and a bonnet assembly (not shown), in place is accomplished by actuating the radial lock mechanism 220 in radially inward direction.

The structure of the embodiment shown in FIG. 18 is similar to the structure of the embodiments described above except for the direction of actuation of the radial lock mechanism 220. Therefore, the discussion of the present embodiment will include a description of how the alternative radial lock mechanism 220 differs from those shown above. Common elements of the embodiments (such as, for example, the bonnet door 36, the linear rods 70, etc.) will not be described again in detail. Moreover, it should be noted that the embodiment of FIG. 18 does not require, for example, actuator cylinders or a radial lock displacement device (e.g., the embodiment of FIG. 18 does not require an internal actuation mechanism).

Figure 19:
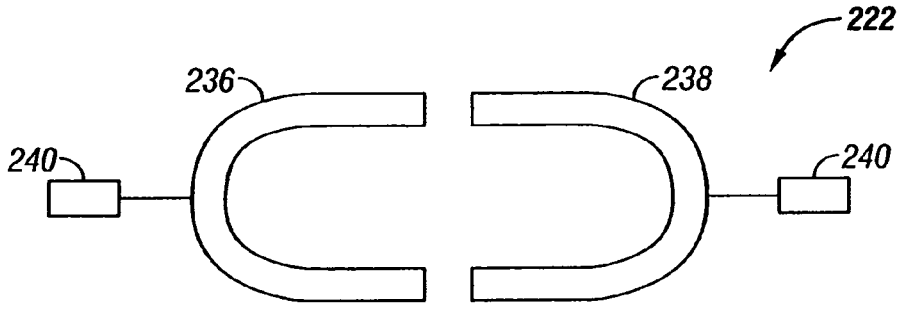
FIG. 19 shows an embodiment of a radial lock comprising two halves.

Actuation of the radial lock 222 is in a radially inward direction. Accordingly, the radial lock 222 must be coupled to an actuation mechanism that differs from, for example, the radial lock displacement device (34 in FIG. 1) and the lock actuators (38 in FIG. 1) described in the previous embodiments. In one embodiment of the invention, the radial lock 222 comprises a structure similar to those shown in FIGS. 6 and 7. As shown in FIG. 19, separate halves 236, 238 of the radial lock 222 may be coupled to radially positioned actuators 240. When the bonnet body 232 is moved into a sealing engagement with the BOP body 230, the actuators 240 are activated to displace the halves 236, 238 of the radial lock 222 in a radially inward direction so that the radial lock 222 engages a groove (244 in FIG. 18) formed on an exterior surface (246 in FIG. 18) of the bonnet body (232 in FIG. 18). The radial lock mechanism (220 in FIG. 18) locks the bonnet body (232 in FIG. 18) and, therefore, the bonnet door (not shown) and the bonnet assembly (not shown) in place and energizes the high pressure seal (234 in FIG. 18). Note that the high pressure seal (234 in FIG. 18) may be formed from any of the embodiments shown above (such as the embodiments described with respect to FIGS. 13–17). Moreover, the radial lock 222 and the groove 244 may comprise angled surfaces (as disclosed in previous embodiments) that produce an axial force that pulls the bonnet body 232 (and the bonnet assembly (not shown) and bonnet door (not shown)) toward the BOP body 230 and further ensure a positive locking engagement.

Figure 20:
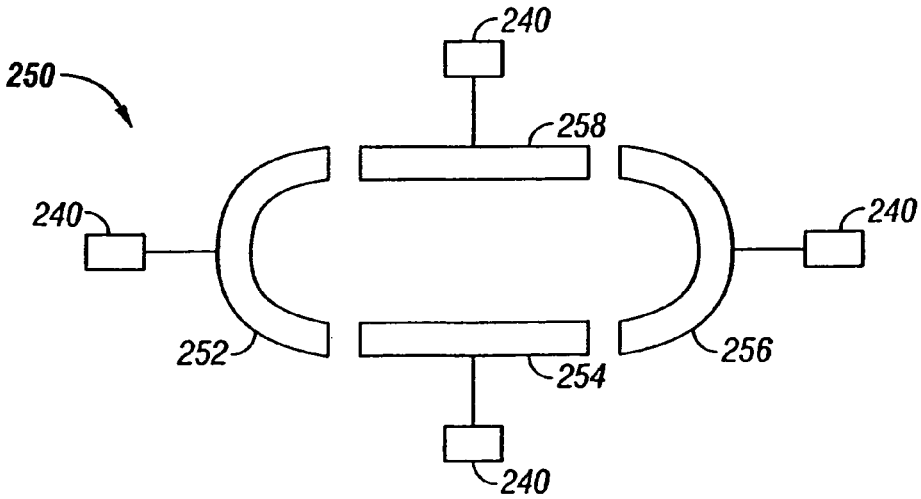
FIG. 20 shows an embodiment of a radial lock comprising four segments.

Moreover, as shown in FIG. 20, the radial lock 222 may comprise more than two parts. If a radial lock 250 comprises, for example, four parts 252, 254, 256, 258, an equal number of actuators 240 (e.g., four) may be used to actuate the radial lock 250. Alternatively, fewer actuators 240 (e.g., less than four in the embodiment shown in FIG. 20) may be used if an actuator 240 is, for example, coupled to more than one part parts 252, 254, 256, 258 of the radial lock 250. The actuators 240 may be hydraulic actuators or any other type of actuator known in the art. Moreover, the actuators 240 may be disposed within the BOP body (230 in FIG. 18) or may be positioned external to the BOP body (230 in FIG. 18). The actuators 240 may be coupled to the radial lock 250 with, for example, mechanical or hydraulic linkages (not shown). On another embodiment, the radial lock 222 comprises a plurality of dies or dogs (not shown) that are coupled to and activated by a plurality of actuators (not shown).

Figure 21:
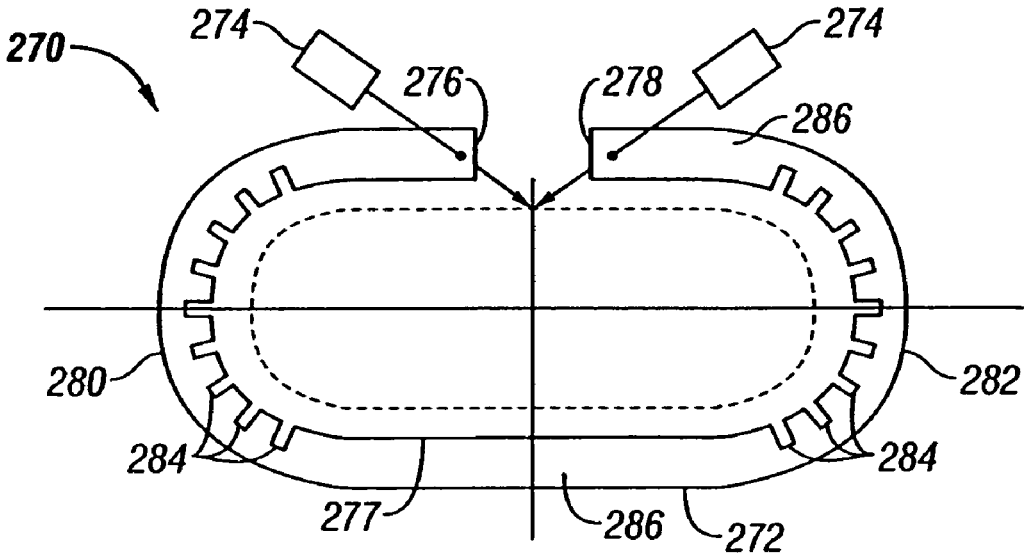
FIG. 21 shows an embodiment of a radial lock comprising a plurality of kerfs.

In another embodiment of the invention shown in FIG. 21, a radial lock 270 may be formed from a single segment 272. The radial lock 270 is actuated by circumferential actuators 274 coupled to the radial lock 270 and disposed proximate ends 276, 278 of the segment 272. When activated, the circumferential actuators 274 move the ends 276, 278 of the segment 272 towards each other and in a radially inward direction as shown by the arrows in FIG. 21. The dashed line in FIG. 21 represents an inner surface 277 of the radial lock 270 after actuation. The radial lock 270, when actuated, engages the bonnet body (232 in FIG. 18) in a manner similar to that shown in FIG. 18.

Figure 22:
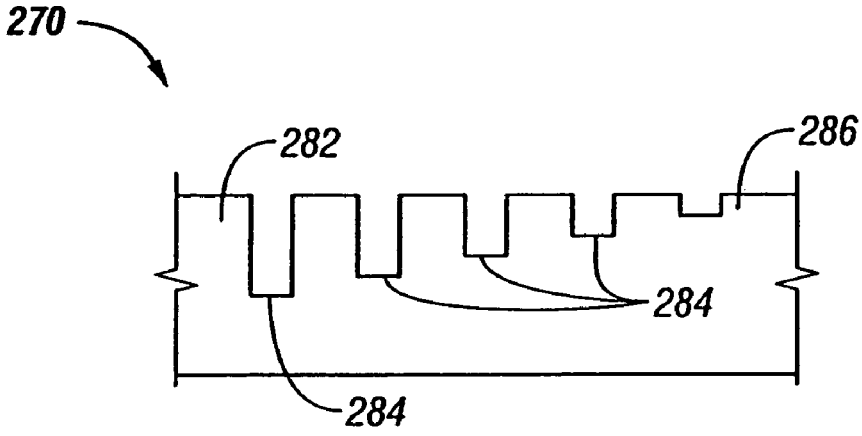
FIG. 22 shows an embodiment of a radial lock comprising graduated kerfs.

The segment 272 of the radial lock 270 may be produced by forming a plurality of kerfs 284 proximate the end segments 280, 282. The kerfs 284 may be designed to ease installation of the radial lock 270 in the recess (224 in FIG. 18) and to improve flexibility for radial deformation of the radial lock 270. The kerfs may be of any shape known in the art. For example, FIG. 22 shows rectangular kerfs 284. However, the kerfs 284 may preferably be formed in a manner that reduces stress concentrations or stress risers at the edges of the kerfs 284. For example, if the kerfs 284 are formed as rectangular shapes, stress risers may form at the relatively sharp corners. Accordingly, the kerfs 284 may comprise filleted corners (not shown) or, for example, substantially trapezoidal shapes (not shown) to minimize the effects of stress risers.

Moreover, the kerfs 284 may be "graduated," as shown in FIG. 22, to produce a substantially smooth transition between relatively stiff straight segments 286 and relatively flexible end segments 280, 282. Graduation of the kerfs 284 effects a smooth stiffness transition that helps prevent stress risers at the last kerf (e.g., at the last kerf proximate the straight segments 286).

The radial lock 270 may be formed from a single material or from different materials (comprising, for example, steel, titanium, beryllium copper, or combinations and/or alloys thereof). For example, the curved end segments 280, 282 may be formed from a material that is relatively compliant when compared to a relatively rigid material forming the straight segments 286 (e.g., the curved and segments 280, 282 may be formed from a material with an elastic modulus ($E_C$) that is substantially lower than an elastic modulus ($E_S$) of the straight segments 286). Regardless of the materials used to form the radial lock 270, the radial lock 270 must be flexible enough to permit installation into and removal from the recess (224 in FIG. 18).

Alternatively, the radial lock 270 of FIG. 21 may comprise more than one segment (e.g., two halves or a plurality of segments) coupled to and actuated by a plurality of circumferential actuators. The radial lock 270 may also comprise a plurality of separate dies or dogs coupled by a flexible band. The dies may be separated by gaps, and the distance of separation may be selected to provide a desired flexibility for the radial lock 270.

The dies and the flexible banding may comprise different materials. For example, the dies may be formed from a substantially stiff material (e.g., a material with a relatively high modulus of elasticity) comprising, for example, steel or nickel based alloys. The flexible banding, in contrast, may be formed from materials having a relatively lower modulus elasticity and comprising, for example, titanium alloys or pultruded flats or shapes comprising fiberglass, carbon fibers, or composite materials thereof. As described above, the radial locks of the embodiments shown in FIGS. 19–22 may be coated with, for example, hardfacing materials (comprising, for example, tungsten carbide, boron nitride, and similar materials known in the art) or low-friction materials (comprising, for example, polytetrafluoroethylene and similar materials known in the art) to, for example, reduce friction and wear and improve the longevity of the parts. The material composition of the radial lock 270 is not intended to be limiting.

The embodiments shown in FIGS. 19–22 may be advantageous because of a reduced bonnet assembly weight and accordingly, reduced overall weight of the BOP. Moreover, there is a potential to retrofit old BOPs to include the radial lock mechanism.

Swivel Slide Mount for Bonnet Assemblies

Referring again to FIG. 1, another important aspect of the invention is the swivel slide mounts 74 cooperatively attached to the rods 70 and to each of the bonnet assemblies 14. As described previously herein, the bonnet assemblies 14 are coupled to the swivel slide mounts 74, and the swivel slide mounts 74 are slidably engaged with the rods 70. The swivel slide mounts 74 are adapted to allow the bonnet assemblies 14 to rotate proximate their axial centerlines so that the rams (not shown) and the interior components of both the bonnet assemblies 14 and the BOP body 12 may be accessed for maintenance, to change the rams, etc.

Figure 23:
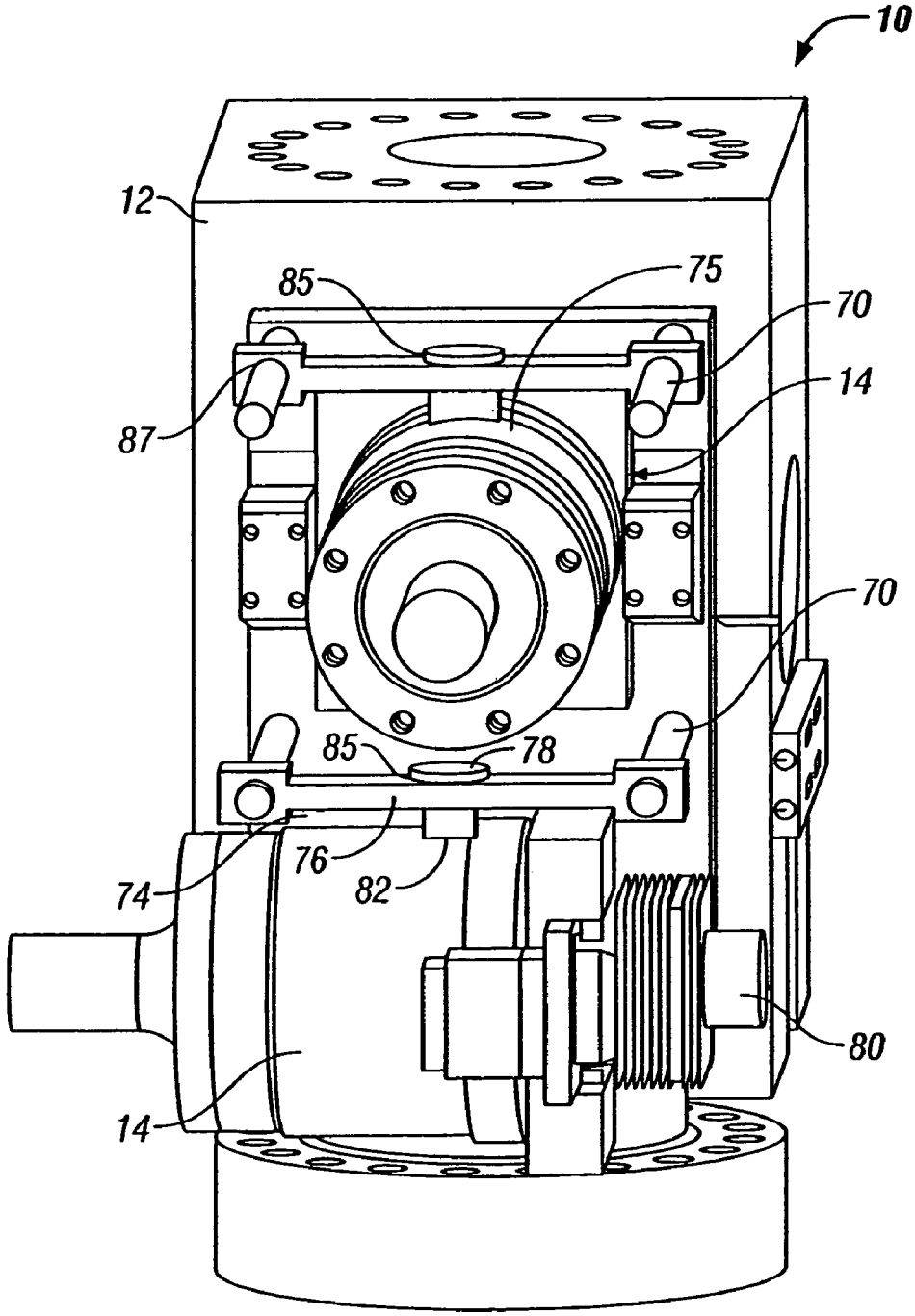
FIG. 23 shows a side perspective view of an embodiment of a swivel slide mount used in one aspect of the invention.
Figure 24:
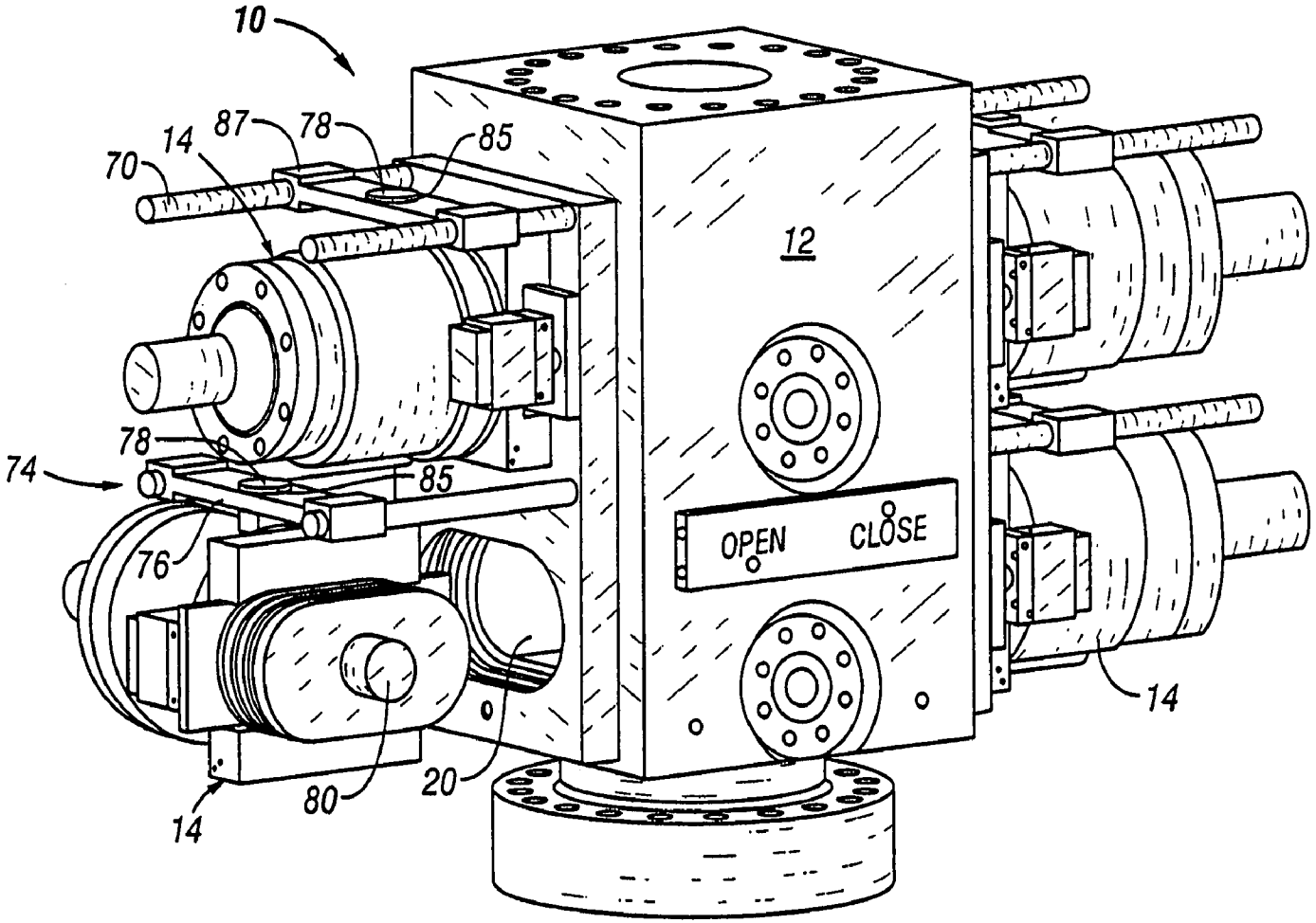
FIG. 24 shows a front perspective view of an embodiment of a swivel slide mount used in one aspect of the invention.

An embodiment of the swivel slide mount 74 is shown in FIGS. 23 and 24. The swivel slide mount 74 comprises a swivel slide mounting bar 76 and a swivel plate 78. The swivel slide mounting bar 76 is slidably attached to the rods 70. The slidable attachment between the swivel slide mounting bar 76 and the rods 70 may be made with, for example, linear bearings 87 that are coupled to the swivel slide mounting bar 76. However, other slidable attachments known in the art may be used with the invention to form the slideable attachment. Moreover, bushings (not shown), or a combination of linear bearings 87 and bushings (not shown) may be used with the invention. The swivel plate 78 is rotationally attached to the swivel slide mounting bar 76 and is cooperatively attached to an upper surface 75 of the bonnet assembly 14. The cooperative attachment of the swivel slide mount 74 to the bonnet assembly 14 is made substantially at an axial centerline of the bonnet assembly 14.

The rods 70 are designed to be of sufficient length to permit the bonnet assembly 14 to disengage from the BOP body 12 and slide away from the BOP body 12 until the ram (not shown) is completely outside the side passage 20. Moreover, a point of attachment 82 where the swivel slide mount 74 is cooperatively attached to the upper surface 75 of the bonnet assembly 14 may be optimized so that the point of attachment 82 is substantially near a center of mass of the bonnet assembly 14. Positioning the point of attachment 82 substantially near the center of mass reduces the force required to rotate the bonnet assembly 14 and also reduces the bending stress experienced by the swivel plate 78.

The swivel plate 78 may further include a bearing 85. For example, the bearing 85 may be cooperatively attached to the swivel slide mounting bar 76 and adapted to withstand both radial and thrust loads generated by the rotation of the bonnet assembly 14. The bearing 85 may comprise, for example, a combination radial bearing and thrust bearing (such as, for example, a tapered roller bearing). Alternatively, the bearing 85 may comprise, for example, a roller bearing to support radial loads and a thrust washer to support axial loads. However, other types of bearing arrangements are known in the art and may be used with the swivel plate 78.

When the ram (not shown) is completely out of the side passage 20, the bonnet assembly 14 can rotate about a rotational axis of the swivel plate 78 so that the ram (not shown) and the side passage 20 may be accessed for maintenance, inspection, and the like. In the embodiment shown in FIGS. 23 and 24, the lower bonnet assembly 14 is shown to be rotated approximately 90 degrees with respect to the BOP body 12 while the upper bonnet assembly 14 remains in locking engagement with the BOP body 12. A ram block attachment point 80 is clearly visible.

Figure 25:
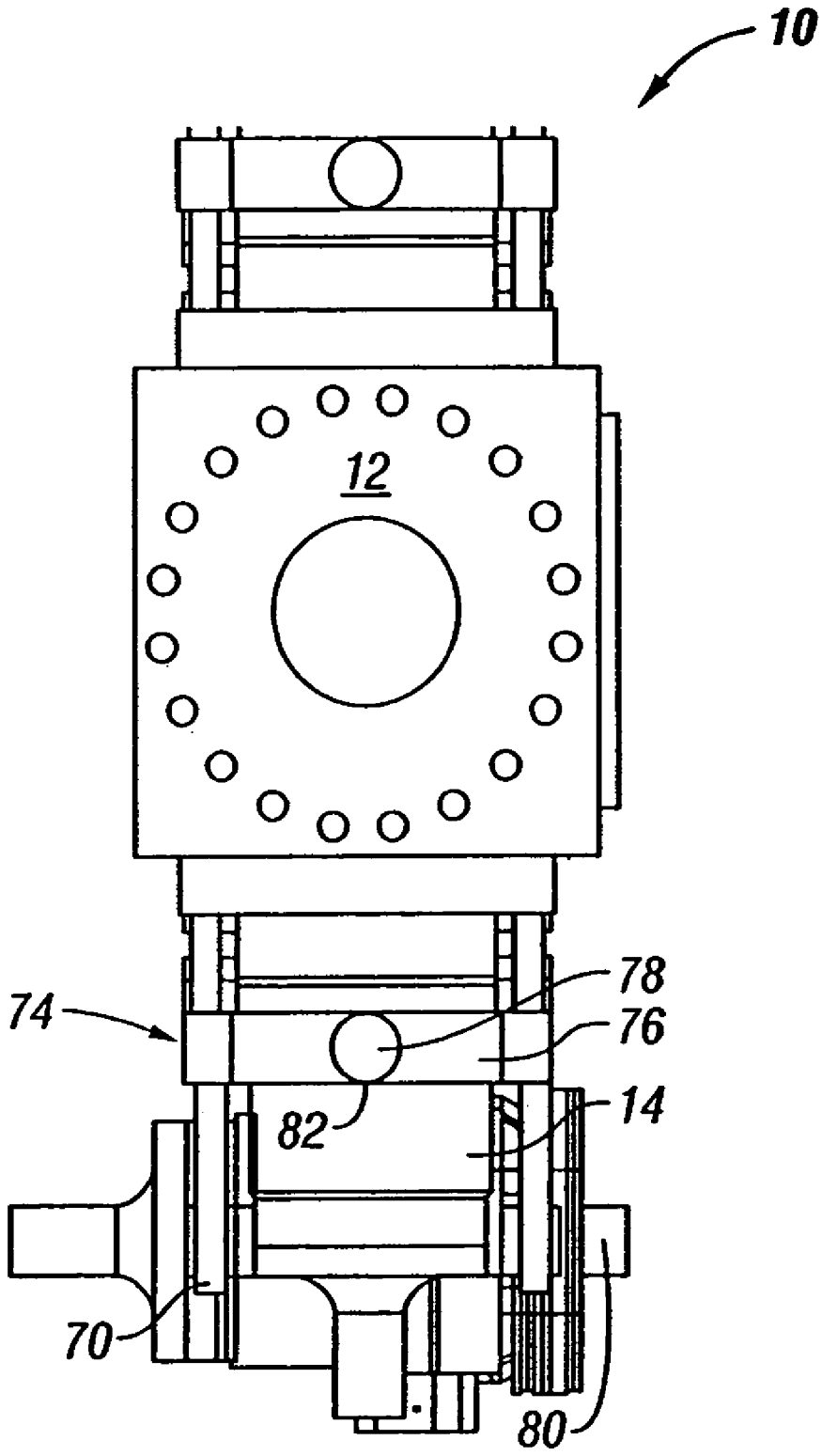
FIG. 25 shows a top perspective view of an embodiment of a swivel slide mount used in one aspect of the invention.

FIG. 25 shows a top view of the BOP 10 when one of the bonnet assemblies 14 has been disengaged from the BOP body 12 and rotated approximately 90 degrees. As shown, the ram block attachment point 80 is clearly visible and may be vertically accessed. Vertical access is a significant advantage because prior art bonnets that include hinges generally pivot about an edge of the bonnet door. Therefore, if, for example, a lower BOP bonnet was unbolted and pivoted open, the ram could not be vertically accessed because the body of the upper BOP bonnet was in the way. Vertical access to the ram is important because it makes it much easier to maintain or replace rams, thus reducing the time required to maintain the BOP and increasing the level of safety of the personnel performing the maintenance. Further, vertical access enables, for example, maintenance of a lower BOP bonnet while an upper bonnet is locked in position (see, for example, FIGS. 23–25).

The bonnet assembly 14 may also be rotated approximately 90 degrees in the other direction with respect to an axis of the side passage (20 in FIG. 1), thereby permitting approximately 180 degrees of rotation. However, other embodiment may be designed that permit rotation of greater than or less than 180 degrees. The range of rotation of the swivel slide mount 74 is not intended to limit the scope of the invention.

The swivel slide mount 74 is advantageous because of the simplicity of the design and attachment to the bonnet assembly 14. For example, prior art hinges are generally complex, difficult to manufacture, and relatively expensive. Further, prior art hinges have to be robust because they carry the full weight of the BOP bonnet about a vertical axis positioned some distance away from the center of mass of the bonnet. The bending moment exerted on the hinge is, as a result, very high and deformation of the hinge can lead to "sagging" of the bonnet.

FIGS. 26–31 show embodiments of a BOP bonnet mount according to the invention. In each of the embodiments, the mount is arranged so that the BOP bonnet can be disengaged from the BOP body and moved away from the BOP body in a direction substantially normal to a face of the BOP body so that the ram is clear of the opening. Once the ram is clear, the bonnet may be pivoted, swiveled, or moved to allow easier access to the ram. "Substantially normal" is used to indicated a direction away from the BOP and the face where the side opening is located. Those having skill in the art will realize that the exact direction will depend on the construction of the BOP, the bonnet, and the side opening, but the direction will generally be normal to a face of the BOP body.

Figure 26:
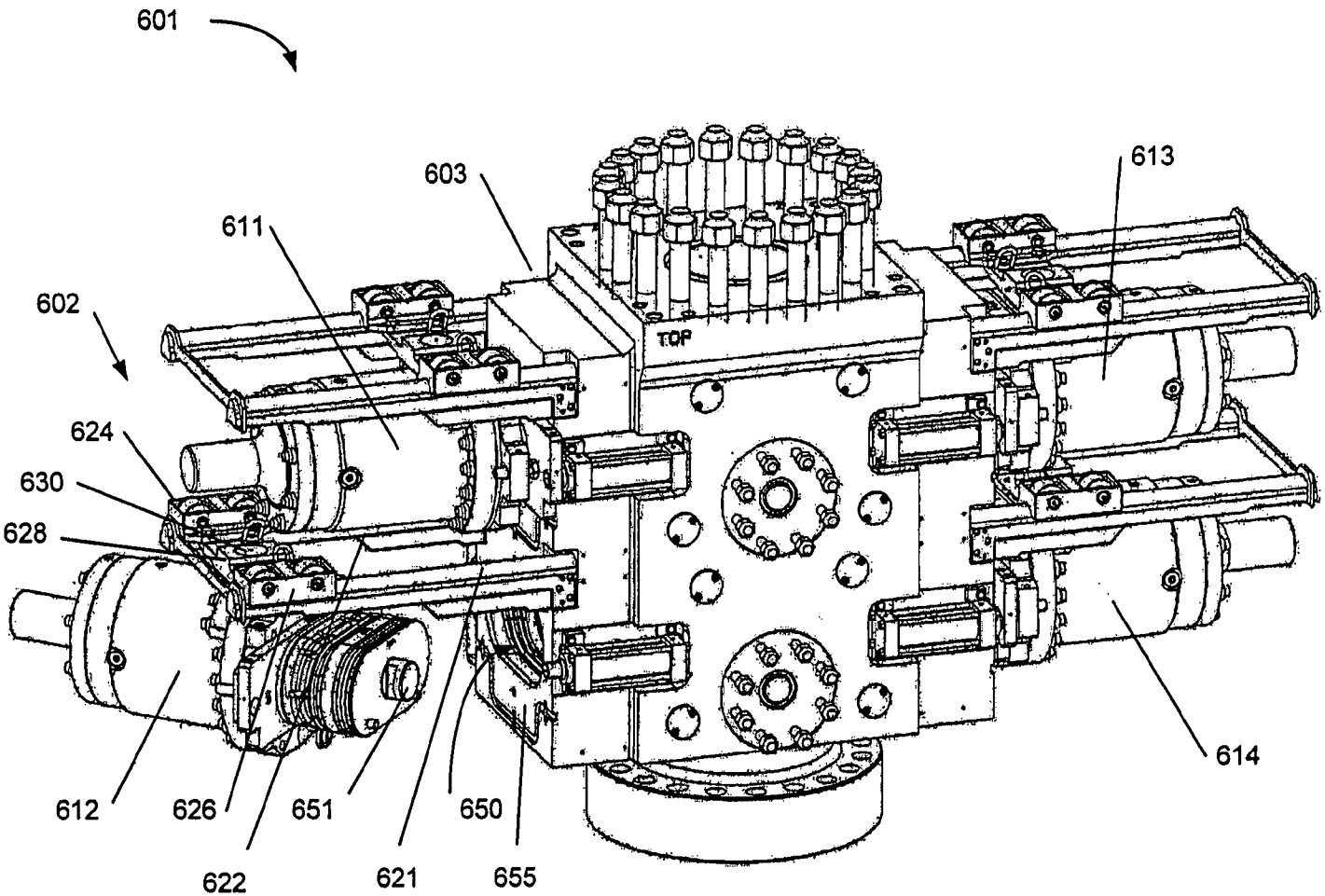
FIG. 26 shows a side perspective view of an embodiment of a bonnet mount used in one aspect of the invention.

FIG. 26 shows one embodiment of a BOP bonnet mount 602 according to one aspect of the invention. A BOP 601 has a BOP body 603 that has four side openings, for example, side opening 650. Four BOP bonnets 611, 612, 613, and 614 may be adapted to be coupled to the side openings. For example, FIG. 26 shows BOP bonnet 612 adapted to be coupled to the BOP body 603 at a side opening 650.

A BOP bonnet mount 602 is also shown in FIG. 26. The BOP bonnet mount 602 comprises two support members 621, 622 and bonnet mounting member 628. The BOP mount 602 enables the BOP bonnet 612 to be moved away from the BOP body 603 in a direction substantially normal to the face 655 of the BOP body 603, and then swiveled so that the ram (not shown) can be more easily replaced.

The support members 621, 622 shown in FIG. 26 are coupled to the BOP body 603. The support members 621, 622 may also be adapted to allow wheels to roll across the top of the support members 621, 622. The support members 621, 622 extend enough distance from the BOP body 603 so that the BOP bonnet 612 may be moved away from the BOP body 603 so that the ram (not shown) is clear of the BOP body 603 and the side opening 650. In this disclosure, "clear" of the BOP body or the side opening means removed to a sufficient extent to that the bonnet may rotate without causing contact between the ram block and the BOP body.

The bonnet mounting member 628 may comprise two wheel blocks 624, 626, and a swivel plate 630. One wheel block is disposed at each end of the bonnet mounting member 628. Each wheel block 624, 626 includes at least one wheel positioned to roll on top of a support member (621 or 622). In the embodiment shown in FIG. 26, each wheel block 624, 626 includes two wheels, although different numbers of wheels can be used without departing from the spirit the invention.

A swivel plate 630 may be rotationally attached to the bonnet mounting member 628 and coupled to the bonnet 612. In some embodiments, the swivel plate 630 is rotationally coupled to the bonnet mounting member 628 near a center of the bonnet mounting member 628. In some other embodiments, the swivel plate 630 is coupled to the bonnet 612 above a center of mass of the bonnet 612. In some embodiments, the swivel plate 630 may be fixedly coupled to the bonnet mounting member 628 and rotationally coupled to the bonnet 612.

A bonnet mount 602 according to the embodiment shown in FIG. 26 enables easier inspection and replacement of a ram (not shown) disposed on the end of a ram piston 651. The bonnet 612 is first disengaged from the BOP body 603. The method of engagement and disengagement of the bonnet is not part of the invention and the invention is not limited by such methods. Next, the bonnet 612 is moved away from the BOP body 603 in a direction substantially normal to a face 655 of the BOP body 603. The bonnet 612 is coupled to the bonnet mounting member 628, and wheels on the bonnet mounting member 628 enable the bonnet 612 to move away from the BOP body 603. Once the ram (not shown) is clear of the side opening 650, the bonnet 612 may be swiveled to either side so that the ram (not shown) can be inspected or replaced.

The embodiment shown in FIG. 26 includes two support members. It is understood that only one support member, or more than two support members, could be used without departing from the spirit of the invention. Similarly, many of the embodiments described with reference to FIGS. 27A–31B include two support members. Again, it is understood that only one support member, or more than two support members, may be used without departing form the spirit of the invention.

FIG. 26 shows three additional bonnets 611, 613, and 614. The operation of the bonnet mounts associated with these bonnets is similar to the one described above. Accordingly, their operation will not be individually described. Further, the embodiments in FIGS. 27A–32 show only one bonnet and the associated bonnet mount. It is understood that each embodiment can be used with any number of bonnets on a BOP. Also, with each aspect of the invention, it is desirable to make any couplings with the bonnet near its center of mass or along a center axis. While it may not be mentioned specifically with certain embodiments of the invention, embodiments may include such a coupling.

Figure 27A:
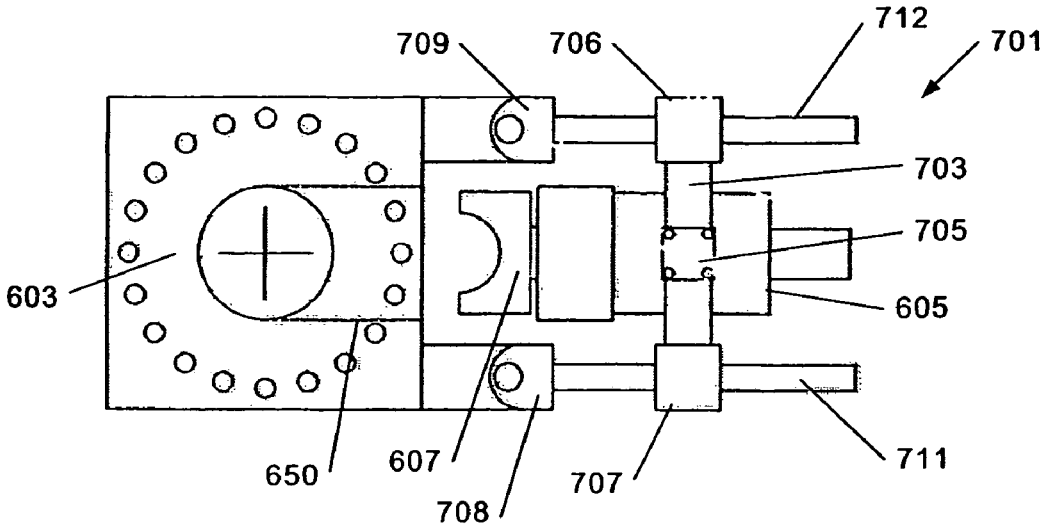
FIG. 27A shows a top view of an embodiment of a bonnet mount used in one aspect of the invention.

FIG. 27A shows a top view of a bonnet mount 701 according to an embodiment of the invention. A bonnet 605 is shown withdrawn from a BOP body 603 so that a ram block 607 is clear of the BOP body 603. The bonnet 605 is coupled to a bonnet mounting member 703 that is moveably coupled to two support members 711, 712. The bonnet mounting member 703 is moveably coupled to the support members 711, 712 by two side blocks 706, 707. The side blocks 706, 707 may comprise linear bearings (as shown in FIG. 23), wheel blocks (as shown in FIG. 26), or any other suitable coupling that enables the bonnet 605 and the bonnet mounting member 703 to be moved away from the BOP body 603 in a direction substantially normal to a face of the BOP body 603.

The bonnet 605 may be rigidly fixed to the bonnet mounting member 703 by a bonnet connector 705. Alternately, the bonnet 605 may be rotationally coupled to the bonnet mounting member 703 by a swivel plate, as described above with reference to FIGS. 23 and 26.

The support members 711, 712 may be hingedly coupled to the BOP body 603. FIG. 27A shows support member 711 hingedly coupled to the BOP body 603 by a hinge 708. Likewise, support member 712 is shown hingedly coupled to the BOP body by hinge 709. The hinges 708, 709 enable the support members 711, 712 to be pivoted so the bonnet moves in a horizontal direction.

Figure 27B:
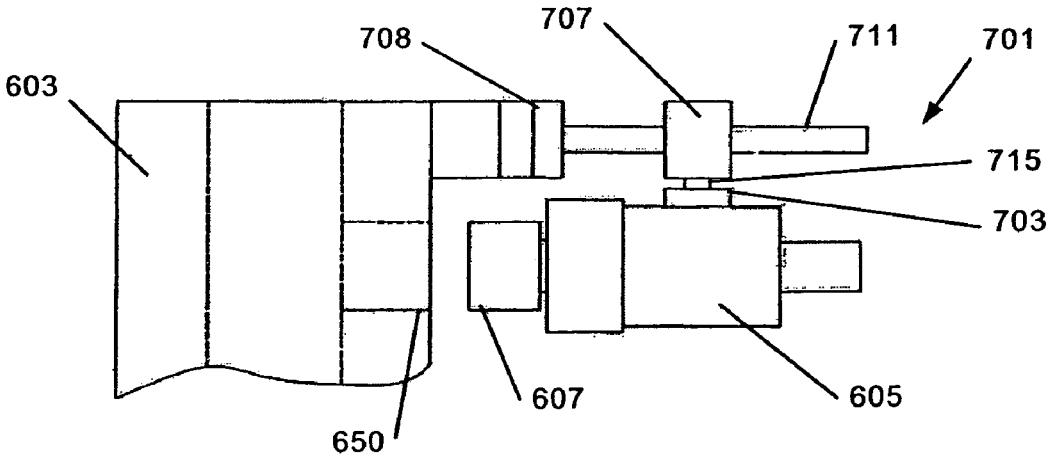
FIG. 27B shows a side view of an embodiment of a bonnet mount used in one aspect of the invention.

FIG. 27B shows a side view of a bonnet mount 701 according to this aspect of the invention. The bonnet 605 is suspended from the support members 711, 712 (only support member 711 is shown in the side view of FIG. 27B). The bonnet mounting member 703 is rotationally coupled to each of the side blocks 706, 707 (only side block 707 is shown in the side view of FIG. 27B). FIG. 27B shows side block 707 rotationally coupled to the bonnet support member 703 at pivot point 715. Although it is not shown in FIG. 27B, it is understood that the bonnet mounting member 703 is similarly coupled to side block 706.

Figure 27C:
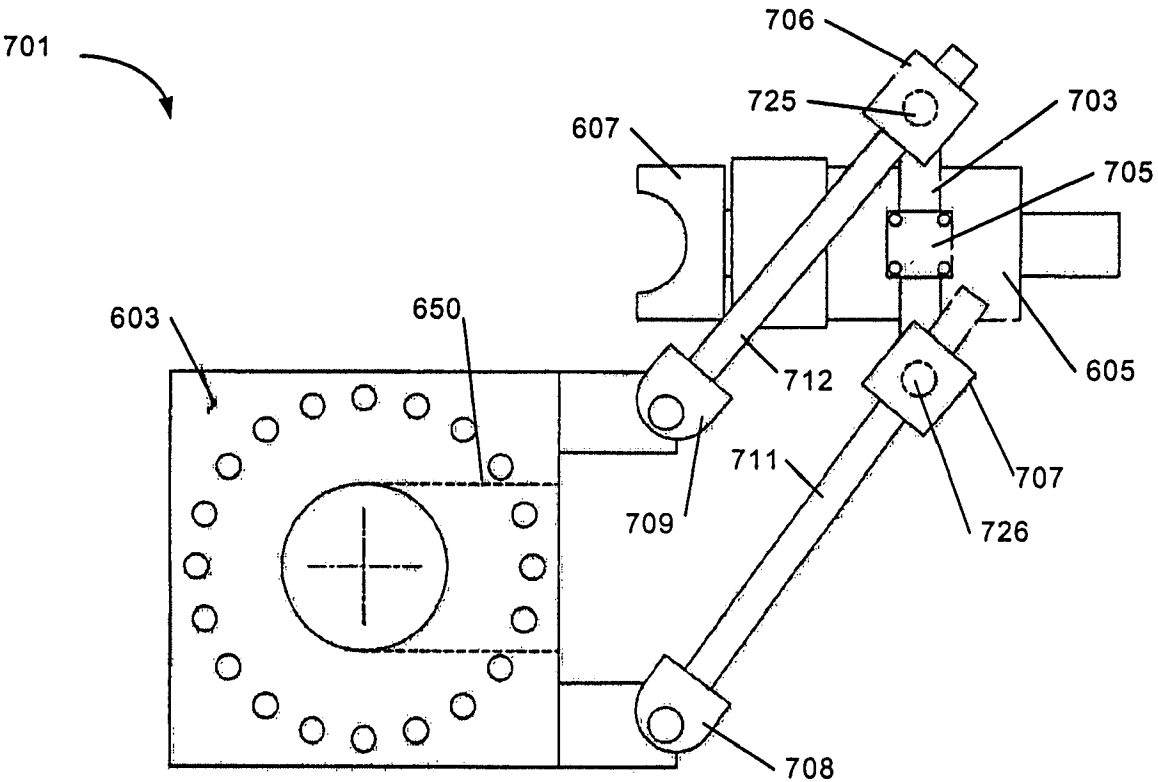
FIG. 27C shows a top view of an embodiment of a bonnet mount used in one aspect of the invention.

FIG. 27C shows is a top view of the bonnet mount 701 with the support members 711, 712 pivoted to one side so that the ram block 607 is more accessible for inspection and replacement. The support members 711, 712 pivot at the points where they are hingedly coupled to the BOP body 603. In the embodiment shown in FIG. 27C, support member 711 is coupled to the BOP body by a hinge 708, and support member 712 is coupled to the BOP body by a hinge 709. The hinged couplings 708, 709 and the rotational couplings of the side blocks 706, 707 enable the bonnet 605 to be horizontally swung away from the BOP body 603 so that the ram block 607 is easily accessible.

The embodiment shown in FIGS. 27A–27C includes a bonnet mount that enables the bonnet to be moved horizontally. In some embodiments (not shown), a bonnet mount may enable the vertical movement of the bonnet. In such an embodiment, the support members could be hingedly coupled to the BOP body so that they pivot in an up or down direction. This would be advantageous, for example, if the ram block could be more easily inspected or replaced from above or below the BOP.

FIGS. 28A–28D show a bonnet mount 801 according to an embodiment of the invention. A bonnet 605 is coupled to a BOP body 603 so that the bonnet 605 can be moved away from the BOP body 603 substantially normal to a face of the BOP body 603. Once the ram block 607 is clear of the BOP body 603, the bonnet 605 is able to rotate in the vertical plane so that the bonnet 603 is facing the other direction.

Figure 28A:
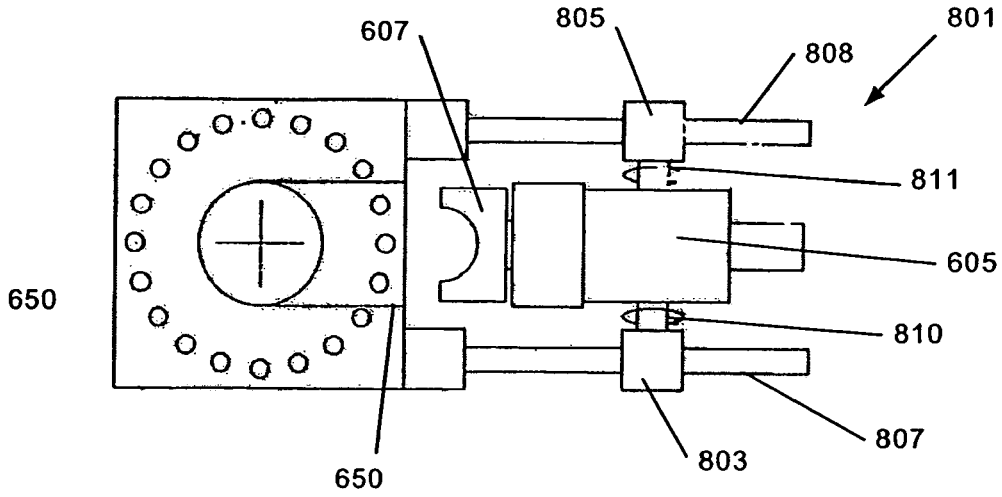
FIG. 28A shows a top view of an embodiment of a bonnet mount used in one aspect of the invention.

FIG. 28A shows a top view of a bonnet mount 801 according to this embodiment of the invention. The bonnet 605 may be coupled to the BOP body 603 by two support members 807, 808, two movement blocks 803, 805, and two bonnet rotational members 810, 811.

The support members 807, 808 are coupled to the BOP body 603 by any means known in the art. In some embodiments, the support members 807, 808 are fixedly coupled to the BOP body 603. Movement block 803 is movably coupled to support member 807, and movement block 805 is moveably coupled to support member 808. The movement blocks 803, 805 are adapted to move along the length of the support members.

In some embodiments, the support members 807, 808 comprise support rods, and the movement blocks 803, 805 comprise linear bearings or bushings that are adapted to slide along the length of the support rods. In another embodiments, the movement blocks 803, 805 each comprise at least one wheel and the support members 807, 808 are adapted to have the at least one wheel roll along the top of the support members 807, 808.

The bonnet 605 may be coupled to the movement blocks 803, 805 by two rotational members 810, 811. Rotational member 810 is coupled to the bonnet 605 and to movement block 803. The second rotational member 811 is coupled to another side of the bonnet 605 and to movement block 805. The rotational members 810, 811 are coupled in such a way as to enable the bonnet 605 to rotate about a horizontal axis. This may be accomplished by fixedly coupling the rotational members 810, 811 to the bonnet 605 and rotationally coupling the rotational members 810, 811 to the movement blocks 803, 805. Conversely, the rotational members 810, 811 could be fixedly coupled to the movement blocks 803, 805 and rotationally coupled to the bonnet 605. Other means of moveably and rotationally coupling a bonnet to support members can be devised without departing from the scope of the invention. For example, all couplings may be rotational couplings.

Figure 28B:
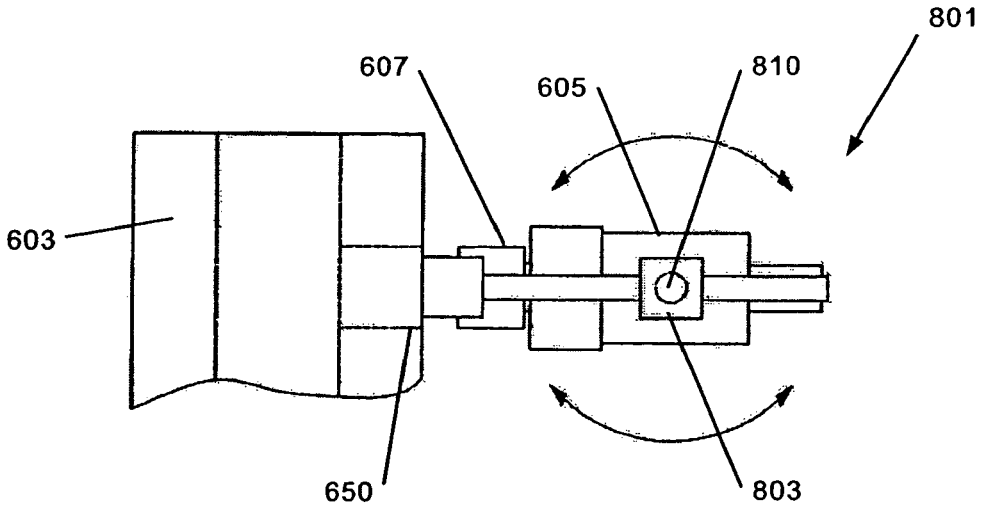
FIG. 28B shows a side view of an embodiment of a bonnet mount used in one aspect of the invention.

FIG. 28B shows a side view of a bonnet mount 801 according to the embodiment of the invention shown in FIG. 28A. The support members 807, 808 (only support member 807 is shown in the side view of FIG. 28B) may be aligned with the horizontal axis of the bonnet 603. The movement blocks 803, 805 (only movement block 803 is shown in the side view of FIG. 28B) and the rotational members (810 and 811 in FIG. 28A) may be aligned near the center of mass of the bonnet 603.

Figure 28C:
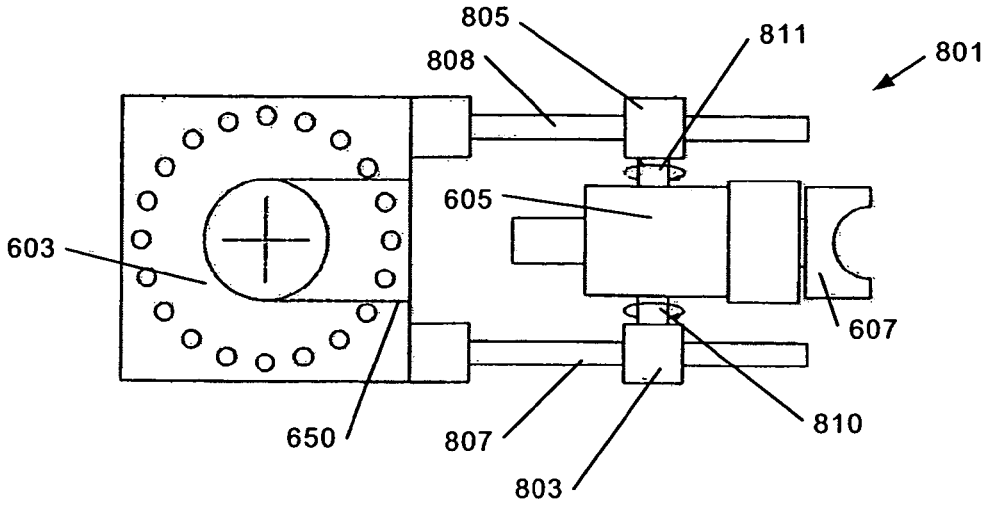
FIG. 28C shows a top view of an embodiment of a bonnet mount used in one aspect of the invention.

FIG. 28C shows a top view of a bonnet mount 801 according to the embodiment of the invention shown in FIGS. 28A and 28B. The bonnet 605 is rotated 180° in the vertical plane so that the ram block 607 is facing away from the BOP body 603. In this position, the ram block 607 may be accessed for inspection and replacement.

Figure 28D:
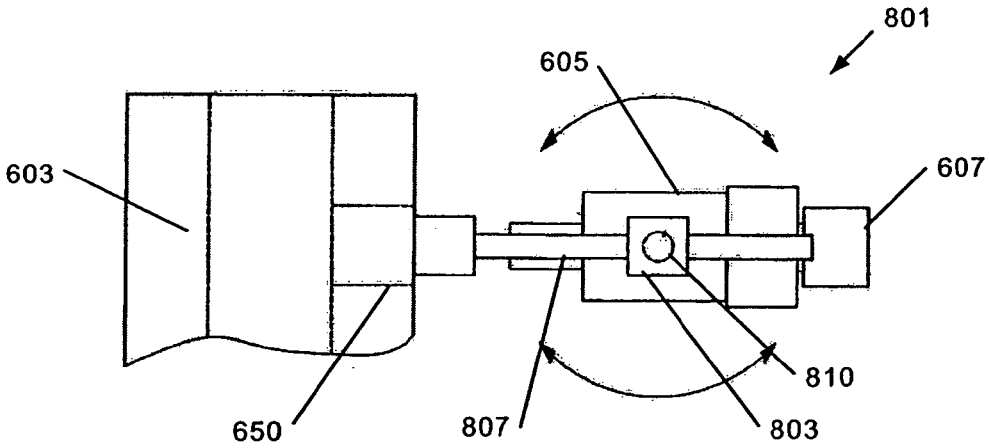
FIG. 28D shows a side view of an embodiment of a bonnet mount used in one aspect of the invention.

FIG. 28D shows a side view of the bonnet mount 801 with the bonnet 605 rotated so that the ram block 607 is facing away from the BOP body 603. The bonnet may rotate from the initial position (as shown in FIG. 28B) in either direction. In some embodiments, the bonnet mount 801 may comprise a lock mechanism that may lock the bonnet 605 in position to be coupled with a side opening 650 in the BOP body 603 or in a 180° rotated position for inspection and replacement. Also, a bonnet mount 801 according to this aspect of the invention may have a lock mechanism that is adapted to lock the bonnet in a 900 position, i.e., with the ram block 607 pointing either up or down. Such a position would be desirable, for example, if conditions made inspecting a ram block 607 from above or below advantageous.

FIGS. 29A–29D show a bonnet mount 901 according to an embodiment of the invention. A bonnet 605 is coupled to a BOP body 603 by at least three support members 911, 912, 913, at least two of which 911, 912 are hingedly coupled to the BOP body 605.

Figure 29A:
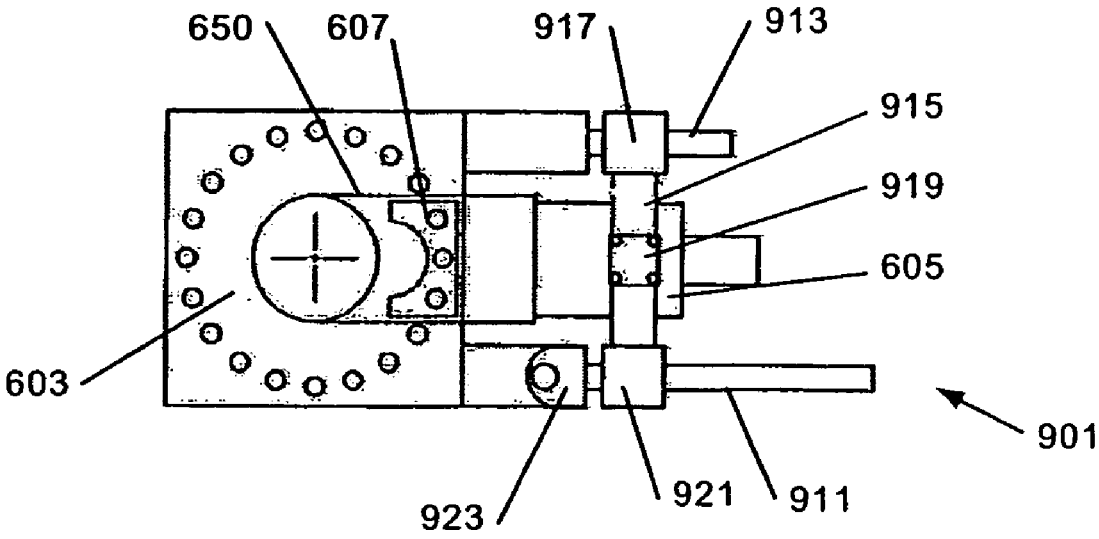
FIG. 29A shows a top view of an embodiment of a bonnet mount used in one aspect of the invention.

FIG. 29A shows a top view of a bonnet mount 901 according to this embodiment of the invention. A bonnet 605 is shown engaged with a BOP body 603, and a ram block 607 is shown located within the BOP body 603. The bonnet 605 is coupled to the BOP body 603 by a bonnet mounting member 915, a vertical bonnet support member 921, and three support members 911, 912, 913 (support member 912 is not shown in the top view of FIG. 29A; see FIGS. 29B and 29C).

Figure 29B:
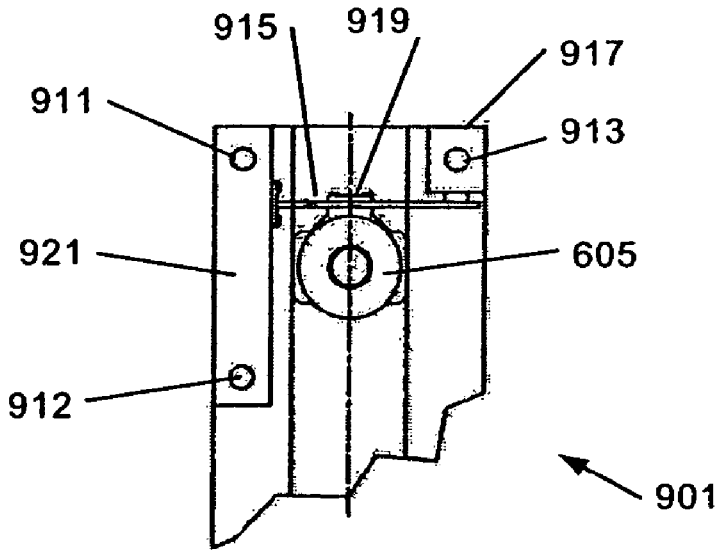
FIG. 29B shows an end view of an embodiment of a bonnet mount used in one aspect of the invention.

FIG. 29B shows an end view of a bonnet mounting member 901. The bonnet 605 is coupled to the bonnet mounting member 915 by a bonnet support plate 919. In some embodiments, the bonnet support plate 919 comprises a fixed coupling, although the bonnet support plate 919 may comprise a rotational coupling without departing from the spirit of the invention.

The bonnet mounting member 915, on one side, is coupled to the vertical bonnet support member 921. On the other side, the bonnet mounting member 915 is coupled to the movement block 917. The bonnet mounting member 915 is shown suspended from the movement block 917, but other coupling types may be used in embodiments of the invention.

Still referring to FIG. 29B, support members 911 and 912 are coupled to the BOP body 603 on one side of the side opening 650, and support member 913 is coupled to the BOP body 603 on the opposing side of the side opening 650. The vertical bonnet support member 921 is movably coupled to support member 911 near the top of the vertical bonnet support member 921, and the vertical bonnet support member 921 is moveably coupled to support member 912 near the bottom of the vertical bonnet support member 921. The movement block 917 is moveably coupled to support member 913.

Figure 29C:
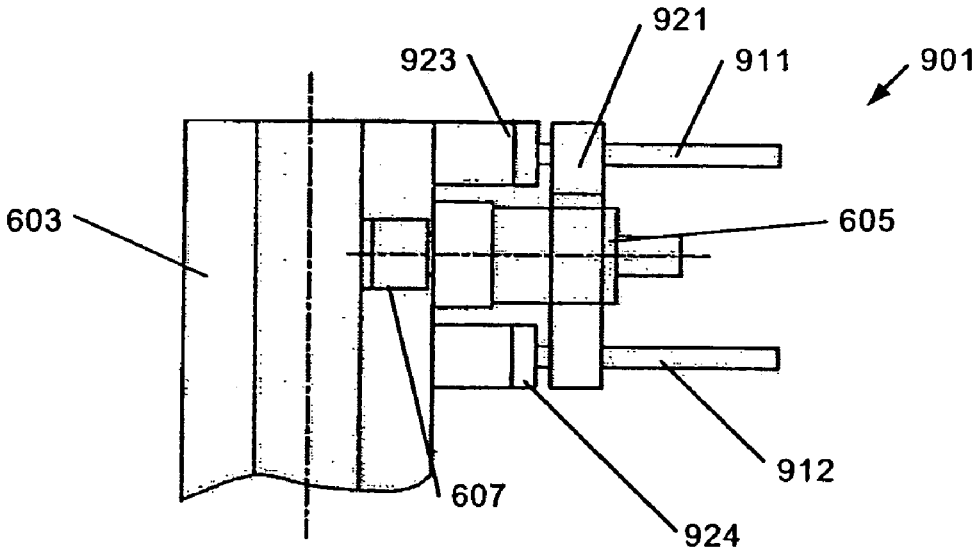
FIG. 29C shows a side view of an embodiment of a bonnet mount used in one aspect of the invention.
Figure 29D:
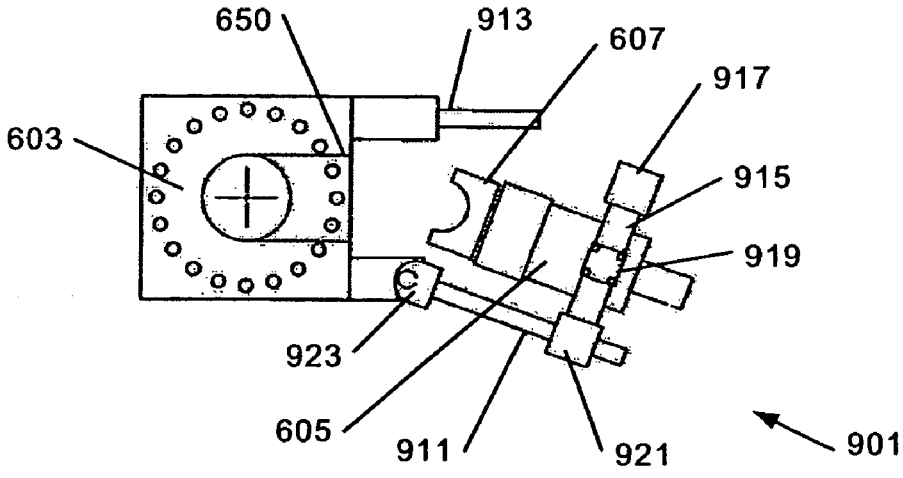
FIG. 29D shows a top view of an embodiment of a bonnet mount used in one aspect of the invention.

As can be seen in FIGS. 29A and 29D, the support members may be of different lengths. Support members 911 and 912 have sufficient length so that the bonnet 605 can be moved substantially normal to a face of the BOP body 603 so that the ram block 607 is clear of the BOP body 603. Side support member 913, on the other hand, may have a length selected so that as the bonnet 605 is moved away from the BOP body 603, the movement block 917 moves past the end of support member 913. In doing so, the movement block 917 becomes decoupled from side support member 913.

Support members 911, 912 may be hingedly coupled to the BOP body 603. As shown in FIGS. 29A and 29D, support member 911 is hingedly coupled to the BOP body 603. The hinged coupling may comprise a hinge 923. Likewise, support member 912, as seen in FIG. 29C, is hingedly coupled to the BOP body 603. The coupling may comprise a hinge 924.

Once the movement block 917 becomes decoupled from support member 913, as can be seen in FIG. 29D, the remaining support members 911, 912 and the bonnet 605 are free to pivot away from the BOP body 603. In some embodiments, the bonnet mount 901 includes stops (not shown) that prevent the support members 911 and 912 and the bonnet 605 from rotating past a selected position. By pivoting about the hinged couplings of support members 911 and 912, the ram block 607 becomes more accessible for inspection and replacement.

To replace the bonnet to the engaged position, as shown in FIG. 29A, the bonnet 605 may be pivoted back toward the BOP body 603. In some embodiments, the bonnet mount 901 includes stops that prevent the support members 911 and 912 and the bonnet from pivoting past the aligned position. The movement block 917 may then be recoupled with support member 913, and the bonnet 605 may be moved toward the BOP body 603 substantially parallel to the axis of the side opening 650.

It is noted that the bonnet mount 901 according to this embodiment of the invention may not include a third support member 913. In that case, the bonnet mounting member 915 would not be coupled with any support member. The bonnet 605 could be moved away from the BOP body 603 and then pivoted once the ram block 607 was clear of the BOP body 603.

Figure 30A:
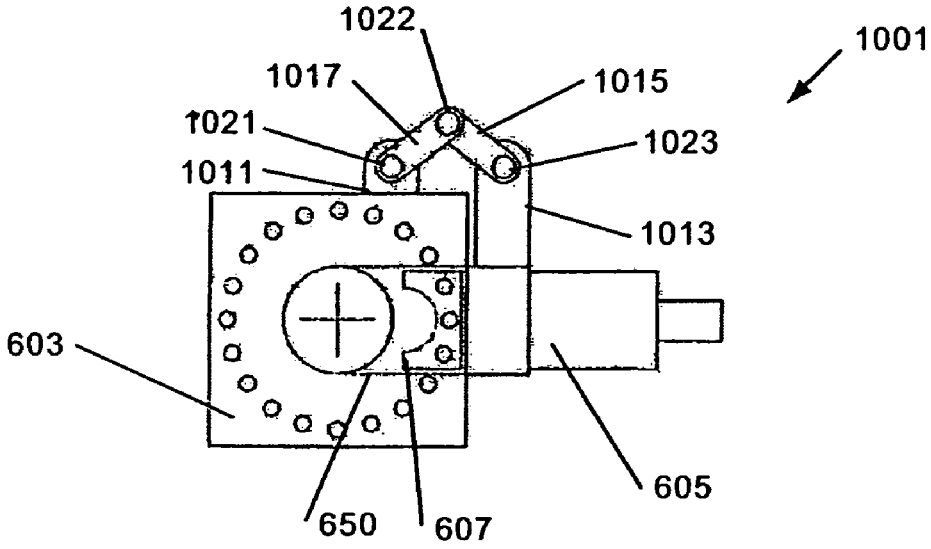
FIG. 30A shows a top view of an embodiment of a bonnet mount used in one aspect of the invention.
Figure 30B:
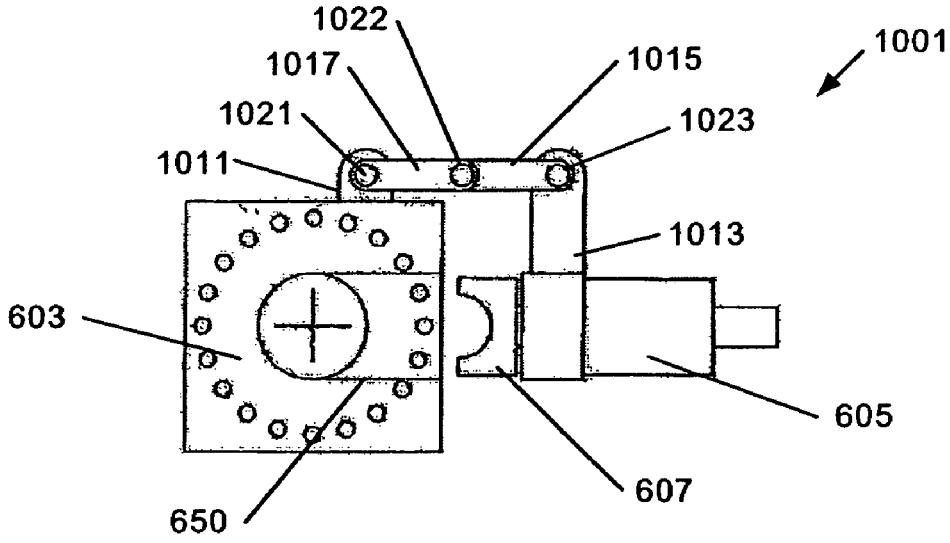
FIG. 30B shows a top view of an embodiment of a bonnet mount used in one aspect of the invention.
Figure 30C:
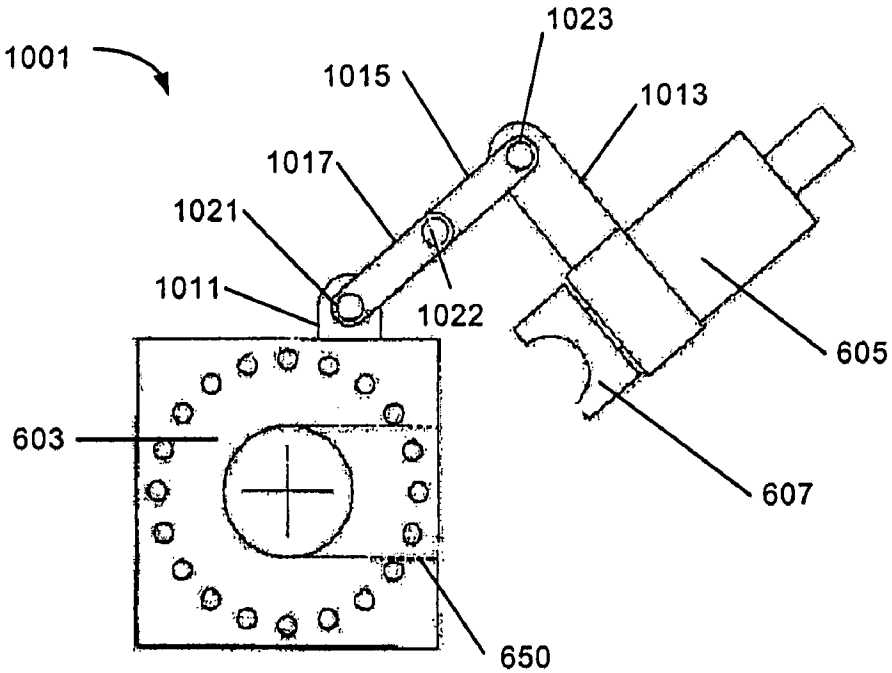
FIG. 30C shows a top view of an embodiment of a bonnet mount used in one aspect of the invention.

FIGS. 30A–30C show a three-pivot hinge bonnet mount 1001 according to an embodiment of the invention. A three-pivot hinge bonnet mount 1001 enables the bonnet 605 to be moved away from a BOP body 603 in a direction substantially normal to a face of the BOP body 603 so that a ram block 607 is clear of the BOP body 603.

FIG. 30A shows a top view of a bonnet 605 engaged with a BOP body 603. The ram block 607 is disposed within the BOP body 603. The bonnet 605 is also coupled to the BOP body 603 by a three-pivot hinge bonnet mount 1001. A three-pivot hinge bonnet mount 1001 according to this embodiment of the invention may include two hinge members 1015, 1017 and three pivot points 1021, 1022, 1023.

A first hinge member 1015 may be hingedly coupled to the bonnet 605 at a bonnet hinge connector 1013. The bonnet coupling may comprise a hinge 1023. A second hinge member may be hingedly coupled to BOP body 603 at a BOP hinge connector 1011. The BOP hinge coupling may comprise a hinge 1021. The first hinge member 1015 and the second hinge member 1017 may be hingedly coupled to each other, each at an opposite end from their coupling to the bonnet 605 and the BOP body 603, respectively. The coupling between the first hinge member 1015 and the second hinge member 1017 hinge members may also be a hinge 1022.

As shown in FIG. 30A, when the bonnet 605 is engaged with the BOP body 603, the hinge members 1015, 1017 form an angle. This enables the bonnet 605 to be moved away from the BOP body 602 substantially normal to a face of the BOP body 603. FIG. 30B shows the bonnet 605 moved away from the BOP body 603 so that the ram block 607 is clear of the BOP body 603. When the bonnet is moved away from the BOP body 603, the hinge members 1015, 1017 may form a straight line between hinges 1021 and 1023. With the ram block 607 clear of the BOP body 603, the bonnet 605 can be pivoted away from the BOP body 603 at any of the hinges 1021, 1022, 1023. FIG. 30C shows a top view of a bonnet 605 pivoted away from a BOP body 603 by pivoting about hinge 1021.

In one or more embodiments (not shown), the hinge bonnet mount may comprise a single member hingedly coupled to a BOP body and to a bonnet. The single member may be linearly extendable so that the bonnet can be moved away from the BOP body along an axis of a side opening. Once moved away, the bonnet could be pivoted away from the BOP body at either of the hinged couplings.

Figure 31A:
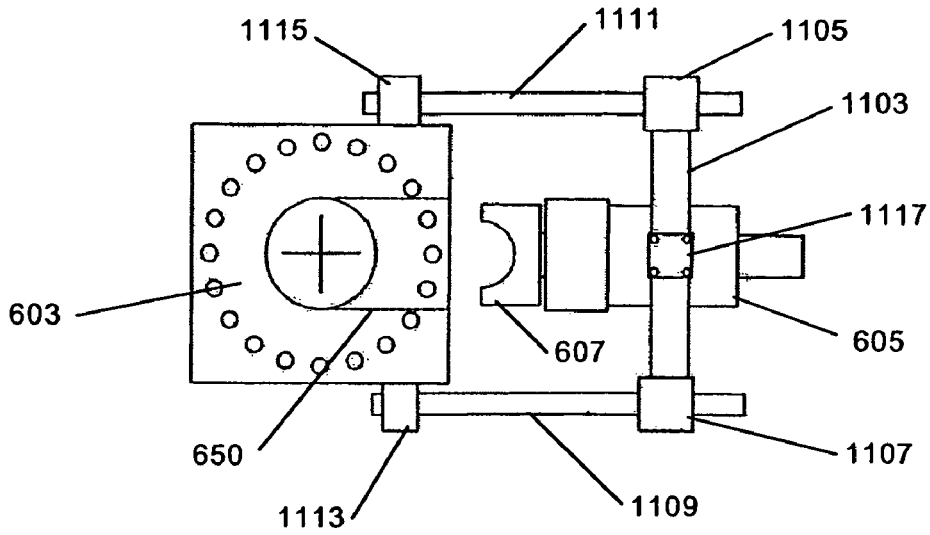
FIG. 31A shows a top view of an embodiment of a bonnet mount used in one aspect of the invention.
Figure 31B:
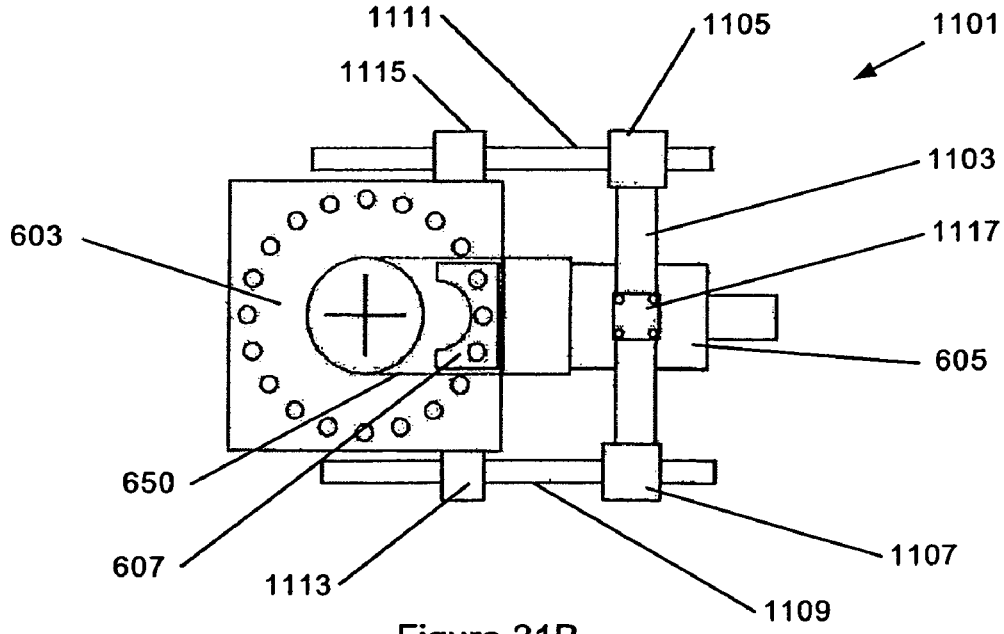
FIG. 31B shows a top view of an embodiment of a bonnet mount used in one aspect of the invention.

FIGS. 31A and 31B show a bonnet mount 1101 according to another embodiment of the invention. In the embodiment shown, support members 1109, 1111 are moveably coupled to the BOP body 603 and may be fixedly coupled to the bonnet 605.

FIG. 31A shows a top view of an embodiment of a bonnet mount 1101 according to the invention. The bonnet 605 may be coupled to a bonnet mounting member 1103 at a connection point 1117. In some embodiments, the bonnet 605 is rotationally coupled to the bonnet mounting member 1103. In one embodiment, the connection point 1117 comprises a swivel plate.

The bonnet mounting member 1103 may be coupled to support members 1109, 1111 at opposite ends of the bonnet mounting member 1103. An end block 1107 may be included at one end of the bonnet mounting member 1103. The end block 1107 may be coupled to support member 1109. A second end block 1105 may be included at a second end of the bonnet mounting member 1103. The second end block 1105 may be coupled to support member 1111. In some embodiments, the bonnet mounting member 1103 may be fixedly coupled to the support members 1109, 1111.

The support members 1109, 1111 may be moveably coupled to the BOP body 603. The BOP body 603 may include support blocks 1113, 1115, which may be moveably coupled to the support members 1109, 1111. In one embodiment, the support blocks 1113, 1115 include linear bearings and adapted to allow the support members 1109, 1111 to slide in and out of the support blocks 1113, 1115.

FIG. 31B shows a bonnet mount 1101 with the bonnet 605 moved away from the BOP body and the ram block 607 clear of the BOP body 603. The support members 1109, 1111 have been moved along with the bonnet 605, in relation to the BOP body 603. In some embodiments, the bonnet 605 is rotationally coupled to the bonnet mounting member 1103 and may be swiveled once the ram block 607 is clear of the BOP body 603.

Advantageously, a bonnet mount according to this embodiment of the invention need not have support members that extend past the bonnet, even when the bonnet is engaged with the BOP body. A mount according to this embodiment requires less space when the bonnet is engaged with the BOP body because the support members do not extend past the bonnet.

Figure 32:
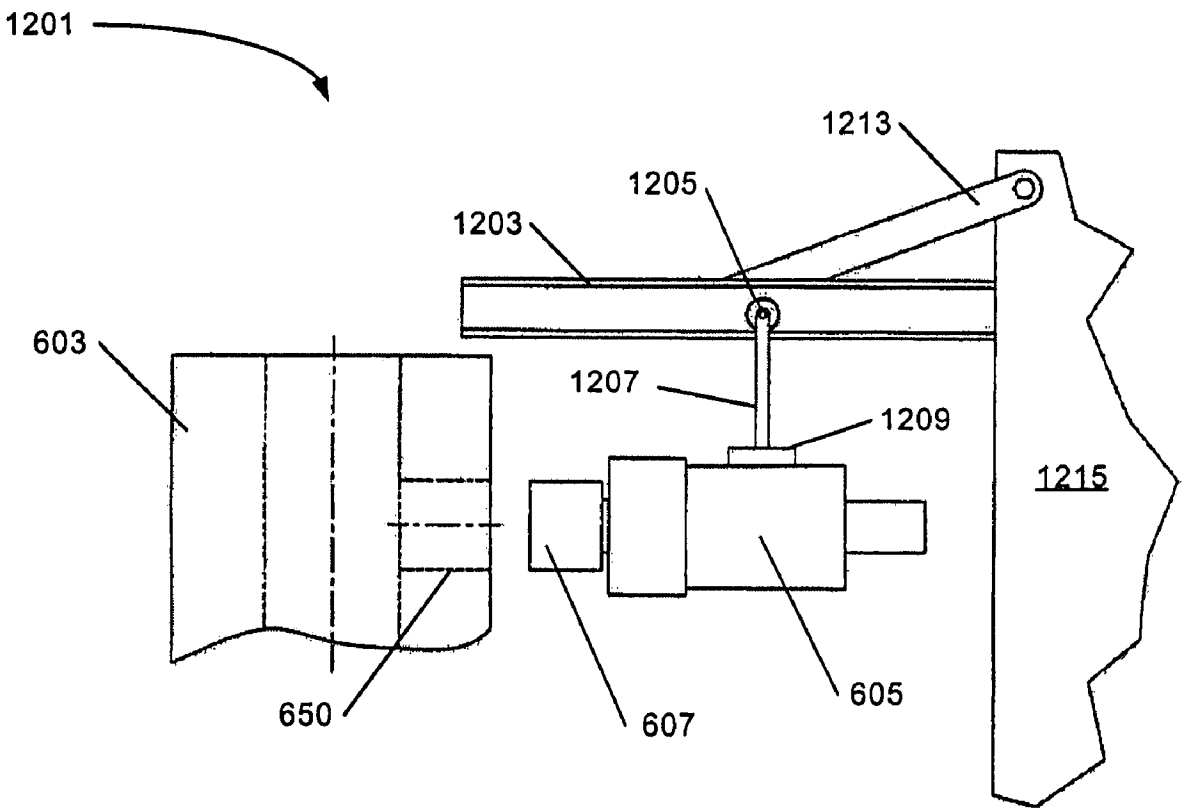
FIG. 32 shows a side view of an embodiment of a bonnet mount used in one aspect of the invention.

FIG. 32 shows a side view of an embodiment of a bonnet mount 1201 according to an embodiment of the invention. In this embodiment, the support members are not coupled to the BOP body 603. Those skilled in the art will appreciate that other embodiments described herein may be applicable is situations where the support members are not coupled to the BOP body 603.

A bonnet 605 is shown moved away from a BOP body 603 so that a ram block 607 is clear of the BOP body 603. The bonnet 605 may be coupled to a vertical support member 1207. In some embodiments, the vertical support member 1207 is rotationally coupled to the bonnet 605 at a rotation point 1209. Rotating the bonnet 605 enables easier access to the ram 607. In other embodiments, the vertical support member 1207 is releasably coupled to the bonnet 605. When the vertical support member 1207 is releasably coupled to the bonnet 605, the vertical support member 1207 may be decoupled from the bonnet 605 and may be used in connection with another bonnet (not shown).

A support member 1203 may be positioned near the bonnet 605 so that the vertical support member 1207 can be coupled to the support member 1203. In some embodiments, the vertical support member 1207 includes at least one wheel 1205 that is adapted to roll along the support member 1203. In some embodiments, the support member 1203 is a rail.

The support member 1203 may be supported by any means known in the art. The means of support for the support member 1203 is not intended to limit the invention. As an example, FIG. 32 shows the support member 1203 connected to a support brace 1213 and a BOP stack frame 1215.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method to access a ram of a blowout preventer, the method comprising: disengaging the bonnet from a sealing engagement with a body of the blowout preventer; moving the bonnet away from the body of the blowout preventer in a direction substantially normal to a face of the body of the blowout preventer; rotating the bonnet with respect to the body of the blowout preventer; and accessing the ram.

2. The method of claim 1, wherein:

at least one support member is coupled to the body of the blowout preventer; and the bonnet comprises at least one bonnet mounting member coupled to the at least one support member.

3. The method of claim 2, wherein the bonnet and the at least one support member rotate together with respect to the body of the blowout preventer.

4. The method of claim 1, wherein the rotation of the bonnet with respect to the body of the blowout preventer occurs in a plane substantially normal to the face of the blowout preventer.

5. The method of claim 1, wherein the rotation of the bonnet with respect to the body of the blowout preventer occurs in a substantially horizontal plane.

6. The method of claim 1, wherein the rotation of the bonnet with respect to the body of the blowout preventer occurs about a rotational axis that intersects a center of mass of the bonnet.

7. The method of claim 1, wherein the bonnet is moved away from the body of the blowout preventer before the bonnet is rotated with respect to the body of the blowout preventer.

8. The method of claim 1, further comprising simultaneously moving and rotating the bonnet away from the body of the blowout preventer in a substantial horizontal plane.

9. The method of claim 1, wherein the bonnet is moved away from and rotated with respect to the body of the blowout preventer in a single motion.

10. A mount to support a bonnet of a blowout preventer, the mount comprising:

at least one support member coupled to a body of the blowout preventer;

a bonnet mounting member moveably coupled to the at least one support member and adapted to move along a first axis substantially normal to a face of the body of the blowout preventer;

wherein the bonnet is coupled to the bonnet mounting member;

wherein the bonnet is in sealing engagement with the body of the blowout preventer in an engaged position; and wherein the bonnet is configured to rotate in a plane about a second axis when not in the engaged position.

11. The mount of claim 10, wherein the plane is substantially horizontal.

12. The mount of claim 10, wherein the second axis is substantially perpendicular to the first axis.

13. The mount of claim 10, wherein the second axis intersects a center mass of the bonnet.

14. The mount of claim 10, wherein the bonnet and the at least one support member rotate in the plane about the second axis.

15. The mount of claim 10, wherein the support members comprise at least one selected from the group consisting of rods, roller supports, and hinge members.

* * * * *

UNITED STATES PATENT AND TRADEMARK OFFICE

CERTIFICATE OF CORRECTION

PATENT NO. : 7,121,348 B2
APPLICATION NO. : 11/388373
DATED : October 17, 2006
INVENTOR(S) : Hemphill et al.

Figure 4:
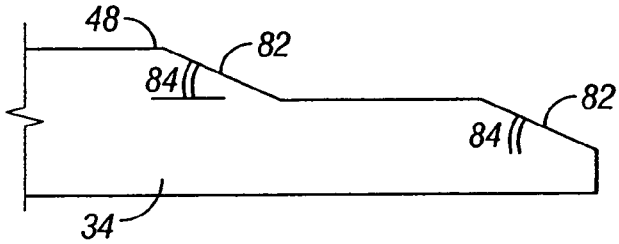
FIG. 4 shows another embodiment of a radial lock displacement device.

It is certified that error appears in the above-identified patent and that said Letters Patent is hereby corrected as shown below:

In Fig. 4, Sheet 3 of 22, for Tag "82" delete " 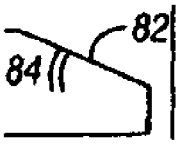

" and insert

-- 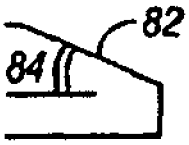

--, therefor.

In Fig. 28A, Sheet 15 of 22, delete " 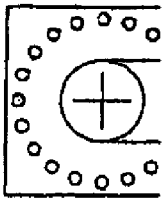

" and insert

-- 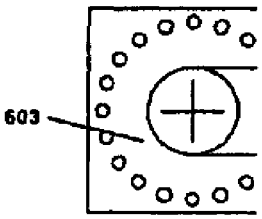

--, therefor.

UNITED STATES PATENT AND TRADEMARK OFFICE

CERTIFICATE OF CORRECTION

PATENT NO. : 7,121,348 B2 
APPLICATION NO. : 11/388373
DATED : October 17, 2006
INVENTOR(S) : Hemphill et al.

It is certified that error appears in the above-identified patent and that said Letters Patent is hereby corrected as shown below:

In Fig. 31 A, Sheet 21 of 22, delete "

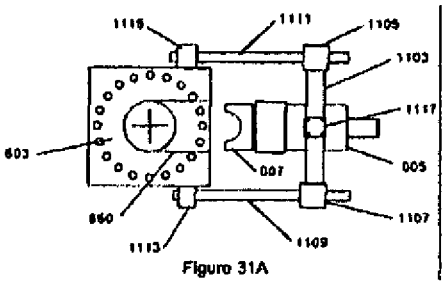

" and insert --

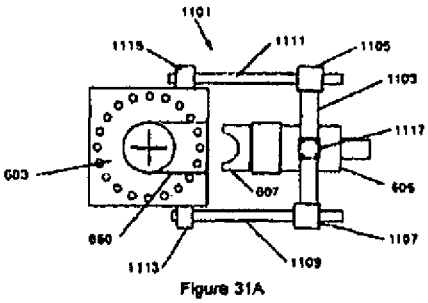

--, therefor.

In Column 24, Line 17, in Claim 13, delete "center mass" and insert -- center of mass --, therefor.

Signed and Sealed this

Second Day of June, 2009

John Doll

JOHN DOLL
*Acting Director of the United States Patent and Trademark Office*